US009919855B2

(12) United States Patent
Vogt et al.

(10) Patent No.: US 9,919,855 B2
(45) **Date of Patent: *Mar. 20, 2018**

(54) PACKAGE INTEGRITY INDICATING CLOSURE

(71) Applicant: Intercontinental Great Brands LLC, East Hanover, NJ (US)

(72) Inventors: Carole A. Vogt, Budd Lake, NJ (US); Jeffrey Thomas Weber, Lake Zurich, IL (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/861,513

(22) Filed: Sep. 22, 2015

(65) Prior Publication Data

US 2016/0083162 A1 Mar. 24, 2016

Related U.S. Application Data

(63) Continuation of application No. 13/669,811, filed on Nov. 6, 2012, now Pat. No. 9,187,228, which is a (Continued)

(51) Int. Cl.
*B65D 33/00* (2006.01)
*B65D 75/58* (2006.01)
*B65D 77/20* (2006.01)

(52) U.S. Cl.
CPC ..... *B65D 75/5833* (2013.01); *B65D 75/5838* (2013.01); *B65D 75/5855* (2013.01); (Continued)

(58) Field of Classification Search
CPC ..... B65D 75/5838; B65D 77/206; B65D 77/2096; B65D 2101/00; B65D 2203/12; (Continued)

(56) References Cited

U.S. PATENT DOCUMENTS 401,974 A 4/1889 Smith
811,092 A 1/1906 Roberts
(Continued)

FOREIGN PATENT DOCUMENTS

AU 2002334419 B2 5/2003
AU 2004295316 6/2005
(Continued)

OTHER PUBLICATIONS

Machine translation of description of JP 04044968 A.*
(Continued)

*Primary Examiner* — Jes F Pascua
(74) *Attorney, Agent, or Firm* — Fitch, Even, Tabin & Flannery LLP

(57) ABSTRACT

A resealable closure or package for a container in which package integrity is indicated by a structure which breaks and/or produces an audible sound when the resealable closure is opened for a first time. The package integrity feature, in one form includes at least one strip or frangible structure that is initially affixed to two portions which comprise the resealable closure so that upon opening the resealable closure for a first time, at least one of the strips breaks. The strips may include a weakened portion such as a narrowing. Integrity of the package is indicated by an intact strip viewable upon opening the resealable closure and conversely, a broken or non-intact strip would indicate that the resealable closure has been previously opened. Package integrity may also be shown by a movable second panel or movable die cut tab portions.

13 Claims, 11 Drawing Sheets

Related U.S. Application Data continuation of application No. 11/693,751, filed on Mar. 30, 2007, now Pat. No. 8,408,792.

(52) U.S. Cl.
CPC ..... *B65D 77/206* (2013.01); *B65D 77/2096* (2013.01); *B65D 2101/00* (2013.01); *B65D 2203/12* (2013.01); *B65D 2575/586* (2013.01); *B65D 2577/205* (2013.01); *B65D 2577/2033* (2013.01); *B65D 2577/2066* (2013.01); *B65D 2577/2091* (2013.01)

(58) Field of Classification Search
CPC ..... B65D 2575/586; B65D 2577/205; B65D 2577/2033; B65D 2577/2066; B65D 2577/2091; B65D 75/5833; B65D 75/5855
USPC .... 383/5, 203, 204, 210, 211, 116, 207, 208
See application file for complete search history.

(56) References Cited

U.S. PATENT DOCUMENTS 1,065,012 A 6/1913 Watanabe
1,106,721 A 8/1914 Lewis
1,171,462 A 2/1916 Rice
1,791,352 A 2/1931 Pascual
1,963,639 A 12/1931 Ahlquist
1,949,161 A 6/1932 Haug
1,978,035 A 9/1932 Thom
1,915,503 A 6/1933 Schmidt
2,033,550 A 3/1936 Rosen
2,034,007 A 3/1936 Elizabeth
2,066,495 A 1/1937 Swift
2,079,328 A 5/1937 Mcbean
2,128,196 A 8/1938 Max
2,248,578 A 7/1941 Arlington
2,260,064 A 10/1941 Stokes
2,320,143 A 5/1943 Sven
2,321,042 A 6/1943 Preis
2,330,015 A 9/1943 Stokes
2,621,788 A 10/1948 Hitchcock
2,475,236 A 7/1949 Matthew
2,605,897 A 10/1949 Rundle
2,554,160 A 5/1951 Von
2,684,807 A 7/1954 Gerrish
2,719,647 A 10/1955 Olive
2,823,795 A 2/1958 Moore
2,965,224 A 12/1960 Harwood
3,080,238 A 3/1963 Howard
3,127,273 A 3/1964 Monahan
3,179,326 A 4/1965 Underwood
3,186,628 A 6/1965 Rohde
3,187,982 A 6/1965 Underwood
3,217,871 A 11/1965 Lee
3,235,165 A 2/1966 Jackson
3,245,525 A 4/1966 Shoemaker
3,259,303 A 7/1966 Repko
3,260,358 A 7/1966 Gottily
3,272,422 A 9/1966 Miller
3,291,377 A 12/1966 Eggen
3,298,505 A 1/1967 Stephenson
3,311,032 A 3/1967 Lucas
3,326,450 A 6/1967 Langdon
3,331,501 A 7/1967 Stewart
3,343,541 A 9/1967 Bellamy
3,373,922 A 3/1968 Watts
3,373,926 A 3/1968 Voigtman
3,454,210 A 7/1969 Spiegel
3,471,005 A 10/1969 Sexstone
3,520,401 A 7/1970 Richter
3,528,825 A 9/1970 Doughty
3,570,751 A 3/1971 Trewella
3,595,466 A 7/1971 Rosenburg
3,595,468 A 7/1971 Repko
3,618,751 A 11/1971 Rich
3,630,346 A 12/1971 Burnside
3,651,615 A 3/1972 Bohner
3,653,502 A 4/1972 Beaudoin
3,685,720 A 8/1972 Brady
3,687,352 A 8/1972 Kalajian
3,740,238 A 6/1973 Graham
3,740,328 A 6/1973 Rausch
3,757,078 A 9/1973 Conti
3,790,744 A 2/1974 Bowen
3,811,564 A 5/1974 Braber
3,865,302 A 2/1975 Kane
3,885,727 A 5/1975 Gilley
3,905,646 A 9/1975 Brackmann
3,909,582 A 9/1975 Bowen
3,910,410 A 10/1975 Shaw
3,938,659 A 2/1976 Wardwell
3,966,046 A 6/1976 Deutschlander
3,971,506 A 7/1976 Roenna
3,979,050 A 9/1976 Cilia
4,082,216 A 4/1978 Clarke
4,113,104 A 9/1978 Meyers
4,140,046 A 2/1979 Marbach
4,143,695 A 3/1979 Hoehn
4,156,493 A 5/1979 Julius
4,185,754 A 1/1980 Julius
4,192,420 A 3/1980 Worrell, Sr.
4,192,448 A 3/1980 Porth
4,197,949 A 4/1980 Carlsson
4,210,246 A 7/1980 Kuchenbecker
4,258,876 A 3/1981 Ljungcrantz
4,260,061 A 4/1981 Jacobs
4,273,815 A 6/1981 Gifford
4,285,681 A 8/1981 Walitalo
4,306,367 A 12/1981 Otto
4,327,862 A 5/1982 Jakobs
4,337,862 A 7/1982 Suter
4,337,882 A 7/1982 Suter
4,364,478 A 12/1982 Tuns
4,397,415 A 8/1983 Lisiecki
4,411,365 A 10/1983 Horikawa
4,420,080 A 12/1983 Nakamura
4,428,477 A 1/1984 Cristofolo
4,460,088 A 7/1984 Rugenstein
4,464,154 A 8/1984 Ljungcrantz
4,488,647 A 12/1984 Davis
4,506,488 A 3/1985 Matt et al.
4,518,087 A 5/1985 Goglio
4,538,396 A 9/1985 Nakamura
4,545,844 A 10/1985 Buchanan
4,548,824 A 10/1985 Mitchell
4,548,852 A 10/1985 Mitchell
4,549,063 A 10/1985 Ang
4,550,831 A 11/1985 Whitford
4,552,269 A 11/1985 Chang
4,557,505 A 12/1985 Schaefer
4,570,820 A 2/1986 Murphy
4,572,377 A 2/1986 Beckett
4,589,943 A 5/1986 Kimball
4,608,288 A 8/1986 Spindler
4,610,357 A 9/1986 Nakamura
4,613,046 A 9/1986 Kuchenbecker
4,616,470 A 10/1986 Nakamura
4,625,495 A 12/1986 Holovach
4,632,299 A 12/1986 Holmberg
4,638,911 A 1/1987 Prohaska
4,648,509 A 3/1987 Alves
4,651,874 A 3/1987 Nakamura
4,653,250 A 3/1987 Nakamura
4,658,963 A 4/1987 Jud
4,667,453 A 5/1987 Goglio
4,671,453 A 6/1987 Cassidy
4,673,085 A 6/1987 Badouard
4,679,693 A 7/1987 Forman
4,694,960 A 9/1987 Phipps
4,696,404 A 9/1987 Corella
4,709,399 A 11/1987 Sanders
4,723,301 A 2/1988 Chang

(56) References Cited

U.S. PATENT DOCUMENTS

| | | | |
|---|---|---|---|
| 4,738,365 | A | 4/1988 | Prater |
| 4,739,879 | A | 4/1988 | Nakamura |
| 4,770,325 | A | 9/1988 | Gordon |
| 4,784,885 | A | 11/1988 | Carespodi |
| 4,786,355 | A | 11/1988 | Kontz |
| 4,790,436 | A | 12/1988 | Nakamura |
| 4,798,295 | A | 1/1989 | Rausing |
| 4,798,296 | A | 1/1989 | Lagerstedt |
| 4,799,594 | A | 1/1989 | Blackman |
| 4,811,848 | A | 3/1989 | Jud |
| 4,818,120 | A | 4/1989 | Addiego |
| 4,838,429 | A | 6/1989 | Fabisiewicz |
| 4,840,270 | A | 6/1989 | Caputo |
| 4,845,470 | A | 7/1989 | Boldt |
| 4,848,575 | A | 7/1989 | Nakamura |
| 4,858,780 | A | 8/1989 | Odaka |
| 4,863,064 | A | 9/1989 | Dailey |
| 4,865,198 | A | 9/1989 | Butler |
| 4,866,911 | A | 9/1989 | Grindrod |
| 4,874,096 | A | 10/1989 | Tessera-Chiesa |
| 4,876,123 | A | 10/1989 | Rivera |
| 4,889,731 | A | 12/1989 | Williams |
| 4,901,505 | A | 2/1990 | Williams, Jr. |
| 4,902,142 | A | 2/1990 | Lammert |
| 4,917,247 | A | 4/1990 | Jud |
| 4,943,439 | A | 7/1990 | Andreas |
| 4,972,953 | A | 11/1990 | Friedman |
| 4,998,666 | A | 3/1991 | Ewan |
| 4,999,081 | A | 3/1991 | Buchanan |
| 5,000,320 | A | 3/1991 | Kuchenbecker |
| 5,001,325 | A | 3/1991 | Huizinga |
| 5,005,264 | A | 4/1991 | Breen |
| 5,010,231 | A | 4/1991 | Huizinga |
| 5,018,625 | A | 5/1991 | Focke |
| 5,029,712 | A | 7/1991 | OBrien |
| 5,040,685 | A | 8/1991 | Focke |
| 5,046,621 | A | 9/1991 | Bell |
| 5,048,718 | A | 9/1991 | Nakamura |
| 5,054,619 | A | 10/1991 | Muckenfuhs |
| 5,060,848 | A | 10/1991 | Ewan |
| 5,065,868 | A | 11/1991 | Cornelissen |
| 5,076,439 | A | 12/1991 | Kuchenbecker |
| 5,077,064 | A | 12/1991 | Hustad |
| 5,078,509 | A | 1/1992 | Center |
| 5,082,702 | A | 1/1992 | Alband |
| 5,085,724 | A | 2/1992 | Focke |
| 5,096,113 | A | 3/1992 | Focke |
| 5,100,003 | A | 3/1992 | Jud |
| 5,103,980 | A | 4/1992 | Kuchenbecker |
| 5,108,669 | A | 4/1992 | vanDijk |
| 5,124,388 | A | 6/1992 | Pruett |
| 5,125,211 | A | 6/1992 | OBrien |
| 5,134,001 | A | 7/1992 | Osgood |
| 5,158,499 | A | 10/1992 | Guckenberger |
| 5,161,350 | A | 11/1992 | Nakamura |
| 5,167,455 | A | 12/1992 | Forman |
| 5,167,974 | A | 12/1992 | Grindrod |
| 5,174,659 | A | 12/1992 | Laske |
| 5,184,771 | A | 2/1993 | Jud |
| 5,190,152 | A | 3/1993 | Smith |
| 5,197,618 | A | 3/1993 | Goth |
| 5,222,422 | A | 6/1993 | Benner |
| 5,222,813 | A | 6/1993 | Kopp |
| 5,229,180 | A | 7/1993 | Littmann |
| 5,294,470 | A | 3/1994 | Ewan |
| 5,307,988 | A | 5/1994 | Focke |
| 5,310,262 | A | 5/1994 | Robison |
| 5,333,735 | A | 8/1994 | Focke |
| 5,344,007 | A | 9/1994 | Nakamura |
| 5,352,466 | A | 10/1994 | Delonis |
| 5,356,068 | A | 10/1994 | Moreno |
| 5,366,087 | A | 11/1994 | Bane |
| 5,371,997 | A | 12/1994 | Kopp |
| 5,374,179 | A | 12/1994 | Swanson |
| 5,375,698 | A | 12/1994 | Ewart |
| 5,381,643 | A | 1/1995 | Kazaitis |
| 5,382,190 | A | 1/1995 | Graves |
| 5,388,757 | A | 2/1995 | Lorenzen |
| 5,405,629 | A | 4/1995 | Marnocha |
| 5,407,070 | A | 4/1995 | Bascos |
| 5,409,115 | A | 4/1995 | Barkhorn |
| 5,409,116 | A | 4/1995 | Aronsen |
| 5,439,102 | A | 8/1995 | Brown |
| 5,454,207 | A | 10/1995 | Storandt |
| 5,460,838 | A | 10/1995 | Wermund |
| 5,460,844 | A | 10/1995 | Gaylor |
| 5,461,845 | A | 10/1995 | Yeager |
| 5,464,092 | A | 11/1995 | Seeley |
| 5,470,015 | A | 11/1995 | Jud |
| 5,489,060 | A | 2/1996 | Godard |
| 5,499,757 | A | 3/1996 | Back |
| 5,503,858 | A | 4/1996 | Reskow |
| 5,505,305 | A | 4/1996 | Scholz |
| 5,515,965 | A | 5/1996 | Boldrini |
| 5,519,982 | A | 5/1996 | Herber |
| 5,520,939 | A | 5/1996 | Wells |
| 5,524,759 | A | 6/1996 | Herzberg |
| 5,531,325 | A | 7/1996 | Deflander |
| 5,538,129 | A | 7/1996 | Chester |
| 5,550,346 | A | 8/1996 | Andriash |
| 5,558,438 | A | 9/1996 | Warr |
| 5,582,342 | A | 12/1996 | Jud |
| 5,582,853 | A | 12/1996 | Marnocha |
| 5,582,887 | A | 12/1996 | Etheredge |
| 5,591,468 | A | 1/1997 | Stockley |
| 5,630,308 | A | 5/1997 | Guckenberger |
| 5,633,058 | A | 5/1997 | Hoffer |
| 5,636,732 | A | 6/1997 | Gilels |
| 5,637,369 | A | 6/1997 | Stewart |
| 5,647,100 | A | 7/1997 | Porchia |
| 5,647,506 | A | 7/1997 | Julius |
| 5,664,677 | A | 9/1997 | OConnor |
| 5,672,224 | A | 9/1997 | Kaufmann |
| 5,688,394 | A | 11/1997 | McBride |
| 5,688,463 | A | 11/1997 | Robichaud |
| 5,702,743 | A | 12/1997 | Wells |
| 5,709,479 | A | 1/1998 | Bell |
| 5,725,311 | A | 3/1998 | Ponsi |
| D394,204 | S | 5/1998 | Seddon |
| D394,605 | S | 5/1998 | Skiba |
| 5,749,657 | A | 5/1998 | May |
| 5,770,283 | A | 6/1998 | Gosselin |
| 5,791,465 | A | 8/1998 | Niki |
| 5,795,604 | A | 8/1998 | Wells |
| 5,819,931 | A | 10/1998 | Boucher |
| 5,820,953 | A | 10/1998 | Beer |
| 5,833,368 | A | 11/1998 | Kaufman |
| 5,855,435 | A | 1/1999 | Chiesa |
| 5,862,101 | A | 1/1999 | Haas |
| 5,873,483 | A | 2/1999 | Goertz |
| 5,873,607 | A | 2/1999 | Waggoner |
| 5,882,116 | A | 3/1999 | Backus |
| 5,885,673 | A | 3/1999 | Light |
| 5,906,278 | A | 5/1999 | Ponsi |
| 5,908,246 | A | 6/1999 | Arimura |
| 5,928,749 | A | 7/1999 | Forman |
| 5,938,013 | A | 8/1999 | Palumbo |
| 5,939,156 | A | 8/1999 | Rossi |
| 5,945,145 | A | 8/1999 | Narsutis |
| 5,956,794 | A | 9/1999 | Skiba |
| 5,993,962 | A | 11/1999 | Timm |
| 5,996,797 | A | 12/1999 | Flaig |
| 5,997,177 | A | 12/1999 | Kaufman |
| 6,006,907 | A | 12/1999 | Sato |
| 6,012,572 | A | 1/2000 | Heathcock |
| 6,015,934 | A | 1/2000 | Lee |
| 6,026,953 | A | 2/2000 | Nakamura |
| 6,028,289 | A | 2/2000 | Robichaud |
| 6,029,809 | A | 2/2000 | Skiba |
| 6,037,381 | A | 3/2000 | Beer |
| 6,056,141 | A | 5/2000 | Navarini |
| 6,060,095 | A | 5/2000 | Scrimager |
| 6,065,591 | A | 5/2000 | Dill |
| 6,066,437 | A | 5/2000 | Kosslinger |

(56) References Cited

U.S. PATENT DOCUMENTS 6,076,969 A 6/2000 Jaisle
6,077,551 A 6/2000 Scrimager
6,099,682 A 8/2000 Krampe
6,113,271 A 9/2000 Scott
6,125,614 A 10/2000 Jones
6,126,009 A 10/2000 Sniffler
6,126,317 A 10/2000 Anderson
6,128,317 A 10/2000 Anderson
6,152,601 A 11/2000 Johnson
6,164,441 A 12/2000 Guy
6,213,645 B1 4/2001 Beer
6,228,450 B1 5/2001 Pedrini
D447,054 S 8/2001 Hill
6,273,610 B1 8/2001 Koyama
6,279,297 B1 8/2001 Latronico
6,296,884 B1 10/2001 Okerfund
6,299,355 B1 10/2001 Schneck
6,309,104 B1 10/2001 Koch
6,309,105 B1 10/2001 Palumbo
6,318,894 B1 11/2001 Derenthal
6,325,877 B1 12/2001 Murphy
6,352,364 B1 3/2002 Mobs
6,364,113 B1 4/2002 Faasse
6,365,255 B1 4/2002 Kittel
6,383,592 B1 5/2002 Lowry
6,402,379 B1 6/2002 Albright
6,420,006 B1 7/2002 Scott
6,427,420 B1 8/2002 Olivieri
6,428,208 B1 8/2002 Addison
6,428,867 B1 8/2002 Scott
6,446,811 B1 9/2002 Wilfong
6,450,685 B1 9/2002 Scott
6,457,585 B1 10/2002 Huffer
6,461,043 B1 10/2002 Healy
6,461,708 B1 10/2002 Dronzek
6,471,817 B1 10/2002 Emmert
6,476,743 B1 11/2002 Brown
6,482,867 B1 11/2002 Kimura
6,502,986 B1 1/2003 Bensur
6,517,243 B2 2/2003 Huffer
6,519,918 B2 2/2003 Forman et al.
6,538,581 B2 3/2003 Cowie
6,539,691 B2 4/2003 Beer
6,554,134 B1 4/2003 Guibert
6,563,082 B2 5/2003 Terada
6,589,622 B1 7/2003 Scott
6,592,260 B1 7/2003 Randall
6,594,872 B2 7/2003 Cisek
6,612,432 B2 9/2003 Motson
6,616,334 B2 9/2003 Faaborg
6,621,046 B2 9/2003 Kaji
6,669,046 B1 12/2003 Sawada
6,691,886 B1 2/2004 Berndt
6,698,928 B2 3/2004 Miller
6,726,054 B2 4/2004 Fagen
6,726,364 B2 4/2004 Perell
6,746,743 B2 6/2004 Knoerzer
6,750,423 B2 6/2004 Tanaka
6,767,604 B2 7/2004 Muir
6,815,634 B2 11/2004 Sonoda
6,821,388 B2 11/2004 Marsh
6,852,947 B2 2/2005 Tanaka
6,865,860 B2 3/2005 Arakawa
6,889,483 B2 5/2005 Compton
6,918,532 B2 7/2005 Sierra-Gomez
6,929,400 B2 8/2005 Razeti
6,932,135 B2 8/2005 Tabuchi
6,945,400 B2 9/2005 Bolnick
6,951,999 B2 10/2005 Monforton
6,969,196 B2 11/2005 Woodham
6,983,875 B2 1/2006 Emmott
7,007,423 B2 3/2006 Andersson
7,018,502 B2 3/2006 Treleaven
7,021,827 B2 4/2006 Compton
7,032,754 B2 4/2006 Kopecky
7,032,757 B2 4/2006 Richards
7,032,810 B2 4/2006 Benedetti et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos
7,207,718 B2 4/2007 Machacek
7,207,719 B2 4/2007 Marbler
7,213,710 B2 5/2007 Cotert
7,228,968 B1 6/2007 Burgess
7,254,873 B2 8/2007 Stolmeier
7,261,468 B2 8/2007 Schneider
7,262,335 B2 8/2007 Motsch
7,302,783 B2 12/2007 Cotert
7,344,744 B2 3/2008 Sierra-Gomez
7,350,688 B2 4/2008 Sierra-Gomez
7,351,458 B2 4/2008 Leighton
7,352,591 B2 4/2008 Sugahara
7,371,008 B2 5/2008 Bonenfant
7,404,487 B2 7/2008 Kumakura
7,416,768 B2 8/2008 Knoerzer
7,422,142 B2 9/2008 Arippol
7,470,062 B2 12/2008 Moteki
7,475,781 B2 1/2009 Kobayashi
7,516,599 B2 4/2009 Doll
7,527,189 B2 5/2009 Billig
7,533,733 B2 5/2009 Nolan
7,533,773 B2 5/2009 Aldridge
7,600,641 B2 10/2009 Burgess
7,703,602 B2 4/2010 Saito
7,708,463 B2 5/2010 Sampaio Camacho
7,717,620 B2 5/2010 Hebert
7,740,923 B2 6/2010 Exner
7,744,517 B2 6/2010 Bonenfant
7,758,484 B2 7/2010 Peterson
7,858,901 B2 12/2010 Krishnan
7,963,413 B2 6/2011 Sierra-Gomez
2,588,409 A1 7/2011 Aldridge
7,971,718 B2 7/2011 Aldridge
8,002,171 B2 8/2011 Ryan
8,002,941 B2 8/2011 Exner
8,029,428 B2 10/2011 Selle
8,038,349 B2 10/2011 Andersson
8,114,451 B2 2/2012 Sierra-Gomez
8,181,784 B2 5/2012 Bouthiette
8,240,546 B2 8/2012 Friebe
8,262,830 B2 9/2012 Hebert
8,262,832 B2 9/2012 Hebert
8,273,434 B2 9/2012 Zietlow
8,308,363 B2 11/2012 Vogt
8,408,792 B2 4/2013 Cole
8,506,165 B2 8/2013 Shinozaki
8,540,839 B2 9/2013 Zietlow
8,544,519 B2 10/2013 Ikeda
8,722,122 B2 * 5/2014 Vogt ..... B65D 75/5838 220/258.3
8,763,890 B2 7/2014 Clark
8,920,030 B2 12/2014 McSweeney
8,951,591 B2 2/2015 Vogt
8,986,803 B2 3/2015 Yoshida
8,999,100 B2 4/2015 Carmichael
9,187,228 B2 * 11/2015 Vogt ..... B65D 75/5838
2001/0000480 A1 4/2001 Stagg
2002/0000441 A1 1/2002 Redmond
2002/0068668 A1 6/2002 Chow
2002/0079247 A1 6/2002 Wilfong
2002/0182359 A1 12/2002 Muir
2003/0002753 A1 1/2003 Stolmeier
2003/0019780 A1 1/2003 Parodi
2003/0039412 A1 2/2003 Rodick
2003/0047695 A1 3/2003 Zik
2003/0051440 A1 3/2003 Chow
2003/0053720 A1 3/2003 Smith
2003/0118255 A1 6/2003 Miller
2003/0127352 A1 7/2003 Buschkiel
2003/0170357 A1 9/2003 Garwood
2003/0180486 A1 9/2003 Pape
2003/0183637 A1 10/2003 Zappa

(56) References Cited

U.S. PATENT DOCUMENTS

| | | | |
|---|---|---|---|
| 2003/0183643 | A1 | 10/2003 | Fagen |
| 2003/0201083 | A1 | 10/2003 | Marsh |
| 2003/0210838 | A1 | 11/2003 | Steele |
| 2003/0217946 | A1 | 11/2003 | Hsu |
| 2003/0223656 | A1 | 12/2003 | Razeti |
| 2004/0011677 | A1 | 1/2004 | Arakawa |
| 2004/0035719 | A1 | 2/2004 | Ebbers |
| 2004/0060974 | A1 | 4/2004 | Dacey |
| 2004/0062838 | A1 | 4/2004 | Castellanos |
| 2004/0067326 | A1 | 4/2004 | Knoerzer |
| 2004/0083680 | A1 | 5/2004 | Compton |
| 2004/0086207 | A1 | 5/2004 | Marbler |
| 2004/0091184 | A1 | 5/2004 | Miller |
| 2004/0112010 | A1 | 6/2004 | Richards |
| 2004/0112771 | A1 | 6/2004 | Bailey |
| 2004/0150221 | A1 | 8/2004 | Brown |
| 2004/0175060 | A1 | 9/2004 | Woodham |
| 2004/0180118 | A1 | 9/2004 | Renger |
| 2004/0206637 | A1 | 10/2004 | Sierra-Gomez |
| 2005/0000965 | A1 | 1/2005 | Boardman |
| 2005/0031233 | A1 | 2/2005 | Varanese |
| 2005/0084186 | A1 | 4/2005 | Caris |
| 2005/0084188 | A1 | 4/2005 | Liao |
| 2005/0116016 | A1 | 6/2005 | LoDuca |
| 2005/0117819 | A1 | 6/2005 | Kingsford |
| 2005/0186368 | A1 | 8/2005 | Leighton |
| 2005/0220371 | A1 | 10/2005 | Machacek |
| 2005/0247764 | A1 | 11/2005 | Sierra-Gomez |
| 2005/0276525 | A1 | 12/2005 | Hebert |
| 2005/0276885 | A1 | 12/2005 | Bennett |
| 2005/0284776 | A1 | 12/2005 | Kobayashi |
| 2006/0000738 | A1 | 1/2006 | Kumakura |
| 2006/0018569 | A1 | 1/2006 | Bonenfant |
| 2006/0066096 | A1 | 3/2006 | Kan |
| 2006/0083446 | A1 | 4/2006 | SampaioCamacho |
| 2006/0124494 | A1 | 6/2006 | Clark |
| 2006/0144911 | A1 | 7/2006 | Sierra-Gomez |
| 2006/0147129 | A1 | 7/2006 | Miller |
| 2006/0171611 | A1 | 8/2006 | Rapparini |
| 2006/0199717 | A1 | 9/2006 | Marbler |
| 2006/0251342 | A1 | 11/2006 | Forman |
| 2006/0257056 | A1 | 11/2006 | Miyake |
| 2006/0257599 | A1 | 11/2006 | Exner |
| 2006/0261050 | A1 | 11/2006 | Krishnan |
| 2006/0283750 | A1 | 12/2006 | Villars |
| 2006/0285779 | A1 | 12/2006 | Golas |
| 2007/0023435 | A1 | 2/2007 | Sierra-Gomez |
| 2007/0023436 | A1 | 2/2007 | Sierra-Gomez |
| 2007/0095709 | A1 | 5/2007 | Saito |
| 2007/0116388 | A1 | 5/2007 | Kuge |
| 2007/0140600 | A1 | 6/2007 | Nowak |
| 2007/0209959 | A1 | 9/2007 | Burgess |
| 2007/0269142 | A1 | 11/2007 | Tyska |
| 2007/0275133 | A1 | 11/2007 | Sierra-Gomez |
| 2008/0013869 | A1 | 1/2008 | Forman |
| 2008/0031555 | A1 | 2/2008 | Roberts |
| 2008/0034713 | A1 | 2/2008 | Kohl |
| 2008/0037911 | A1 | 2/2008 | Cole |
| 2008/0041750 | A1 | 2/2008 | Kohlweyer |
| 2008/0053861 | A1 | 3/2008 | Mellin |
| 2008/0060751 | A1 | 3/2008 | Arrindell |
| 2008/0063324 | A1 | 3/2008 | Bernard |
| 2008/0063759 | A1 | 3/2008 | Raymond |
| 2008/0063760 | A1 | 3/2008 | Raymond |
| 2008/0101733 | A1 | 5/2008 | Fenn-Barrabass |
| 2008/0131035 | A1 | 6/2008 | Rogers |
| 2008/0135428 | A1 | 6/2008 | Tallier |
| 2008/0152264 | A1 | 6/2008 | Pokusa |
| 2008/0156861 | A1 | 7/2008 | Sierra-Gomez |
| 2008/0159666 | A1 | 7/2008 | Exner |
| 2008/0199109 | A1 | 8/2008 | Rutzinger |
| 2008/0203141 | A1 | 8/2008 | Friebe |
| 2008/0214376 | A1 | 9/2008 | Bonenfant |
| 2008/0220227 | A1 | 9/2008 | Keeney |
| 2008/0240627 | A1 | 10/2008 | Cole |
| 2008/0273821 | A1 | 11/2008 | Doll |
| 2008/0292225 | A1 | 11/2008 | Dayrit |
| 2009/0001143 | A1 | 1/2009 | Cowan |
| 2009/0014491 | A1 | 1/2009 | Fuisz |
| 2009/0022431 | A1 | 1/2009 | Conner |
| 2009/0028472 | A1 | 1/2009 | Andersson |
| 2009/0053372 | A1 | 2/2009 | Hambrick |
| 2009/0074333 | A1 | 3/2009 | Griebel |
| 2009/0097786 | A1 | 4/2009 | Goglio |
| 2009/0161995 | A1 | 6/2009 | Henderson |
| 2009/0190866 | A1 | 7/2009 | Hughes |
| 2009/0211938 | A1 | 8/2009 | Aldridge |
| 2009/0226117 | A1 | 9/2009 | Davis |
| 2009/0232425 | A1 | 9/2009 | Tai |
| 2009/0273179 | A1 | 11/2009 | Scott |
| 2009/0301903 | A1 | 12/2009 | Andersson |
| 2010/0002963 | A1 | 1/2010 | Holbert |
| 2010/0018974 | A1 | 1/2010 | Lyzenga |
| 2010/0019022 | A1 | 1/2010 | Ryan |
| 2010/0111453 | A1 | 5/2010 | Dierl |
| 2010/0113241 | A1 | 5/2010 | Herbert |
| 2010/0147724 | A1 | 6/2010 | Mitra-Shah |
| 2010/0172604 | A1 | 7/2010 | Andersson |
| 2010/0226598 | A1 | 9/2010 | Stoeppelmann |
| 2010/0230303 | A1 | 9/2010 | Buse |
| 2010/0230411 | A9 | 9/2010 | Sierra-Gomez |
| 2010/0278454 | A1 | 11/2010 | Huffer |
| 2010/0303391 | A9 | 12/2010 | Cole |
| 2011/0035399 | A1 | 2/2011 | Deng |
| 2011/0049158 | A1 | 3/2011 | Bouthiette |
| 2011/0058755 | A1 | 3/2011 | Guibert |
| 2011/0127319 | A1 | 6/2011 | Golden |
| 2011/0132976 | A1 | 6/2011 | Drenowski |
| 2011/0147443 | A1 | 6/2011 | Igo |
| 2011/0204056 | A1 | 8/2011 | Veternik et al. |
| 2011/0253718 | A1 | 10/2011 | Sierra-Gomez |
| 2012/0125932 | A1 | 5/2012 | Sierra-Gomez |
| 2012/0128835 | A1 | 5/2012 | Lyzenga |
| 2012/0177307 | A1 | 7/2012 | Duan |
| 2013/0004626 | A1 | 1/2013 | Renders et al. |
| 2013/0011527 | A1 | 1/2013 | Renders |
| 2013/0064477 | A1 | 3/2013 | Vogt |
| 2013/0064934 | A1 | 3/2013 | Vogt |
| 2013/0114918 | A1 | 5/2013 | Lyzenga |
| 2013/0121623 | A1 | 5/2013 | Lyzenga |
| 2013/0121624 | A1 | 5/2013 | Lyzenga |
| 2013/0205964 | A1 | 8/2013 | Matsushita |
| 2013/0270268 | A1 | 10/2013 | Lyzenga |
| 2014/0185965 | A1 | 7/2014 | Lyzenga |
| 2014/0270597 | A1 | 9/2014 | Friedman |
| 2014/0314339 | A1 | 10/2014 | Docherty |
| 2015/0016756 | A1 | 1/2015 | Down |
| 2015/0021219 | A1 | 1/2015 | Oliveira |

FOREIGN PATENT DOCUMENTS

| | | | |
|---|---|---|---|
| AU | 2006337982 | | 8/2007 |
| AU | 2007309154 | | 5/2008 |
| AU | 2008223524 | | 9/2008 |
| AU | 2008229190 | | 9/2008 |
| BR | 55008852 | | 11/2001 |
| BR | 62020307 | | 4/2003 |
| BR | 68046367 | | 10/2009 |
| CN | 1224396 | A | 7/1999 |
| CN | 1781819 | A | 6/2006 |
| DE | 1848870 | | 3/1962 |
| DE | 3700988 | A1 | 7/1988 |
| DE | 3835721 | A1 | 5/1990 |
| DE | 9003401 | | 5/1990 |
| DE | 9005297 | | 8/1990 |
| DE | 90140656 | | 4/1991 |
| DE | 4134567 | | 1/1993 |
| DE | 4241423 | | 6/1994 |
| DE | 19738411 | | 3/1999 |
| DE | 19822328 | A1 | 11/1999 |
| DE | 202004012301 | | 12/2004 |
| DE | 20122333 | | 3/2005 |
| DE | 202007005487 | | 6/2007 |
| DE | 102007030267 | A1 | 1/2009 |

(56) References Cited

FOREIGN PATENT DOCUMENTS

| | | | | |
|---|---|---|---|---|
| DE | 202009000302 | | | 3/2009 |
| DE | 102010019867 | A1 | | 9/2011 |
| EP | 0085289 | | | 8/1983 |
| EP | 0298054 | A2 | | 1/1989 |
| EP | 0307924 | A2 | | 3/1989 |
| EP | 0388310 | | | 9/1990 |
| EP | 0396967 | A2 | | 11/1990 |
| EP | 408831 | A1 | | 1/1991 |
| EP | 0447636 | | | 9/1991 |
| EP | 0474981 | A1 | | 3/1992 |
| EP | 0488967 | | | 6/1992 |
| EP | 0546369 | | | 6/1993 |
| EP | 0667828 | | | 5/1994 |
| EP | 0608909 | | | 8/1994 |
| EP | 0613824 | | | 9/1994 |
| EP | 0629561 | A2 | | 12/1994 |
| EP | 0661154 | | | 7/1995 |
| EP | 0669204 | B2 | | 8/1995 |
| EP | 0744357 | | | 11/1996 |
| EP | 0752375 | | | 1/1997 |
| EP | 0758993 | | | 2/1997 |
| EP | 0796206 | | | 9/1997 |
| EP | 0796208 | | | 9/1997 |
| EP | 0905048 | A | | 3/1999 |
| EP | 1046594 | | | 10/2000 |
| EP | 1056066 | | | 11/2000 |
| EP | 1086906 | A2 | | 3/2001 |
| EP | 1136379 | | | 9/2001 |
| EP | 1288139 | | | 3/2003 |
| EP | 1318081 | A1 | | 6/2003 |
| EP | 1350741 | | | 10/2003 |
| EP | 1375380 | A1 | | 1/2004 |
| EP | 1382543 | A2 | | 1/2004 |
| EP | 1437311 | A1 | | 7/2004 |
| EP | 1449789 | A1 | | 8/2004 |
| EP | 1457424 | | | 9/2004 |
| EP | 1468936 | | | 10/2004 |
| EP | 1477425 | A1 | | 11/2004 |
| EP | 1488936 | | | 12/2004 |
| EP | 1608567 | | | 12/2005 |
| EP | 1609737 | | | 12/2005 |
| EP | 1619137 | A1 | | 1/2006 |
| EP | 1637472 | A1 | | 3/2006 |
| EP | 1697230 | | | 9/2006 |
| EP | 1351861 | | | 10/2006 |
| EP | 1712468 | | | 10/2006 |
| EP | 1712488 | A1 | | 10/2006 |
| EP | 1755980 | | | 2/2007 |
| EP | 1760006 | A1 | | 3/2007 |
| EP | 1770025 | | | 4/2007 |
| EP | 1846306 | | | 10/2007 |
| EP | 1858776 | | | 11/2007 |
| EP | 1873082 | A1 | | 1/2008 |
| EP | 1908696 | | | 4/2008 |
| EP | 1939107 | | | 7/2008 |
| EP | 1975081 | A1 | | 10/2008 |
| EP | 2033910 | | | 3/2009 |
| EP | 2189506 | | | 5/2010 |
| FR | 1327914 | A | | 5/1963 |
| FR | 2674509 | | | 10/1992 |
| FR | 2693988 | | | 1/1994 |
| FR | 2766794 | | | 2/1999 |
| FR | 2772009 | | | 6/1999 |
| FR | 2783512 | | | 3/2000 |
| GB | 1107200 | | | 3/1968 |
| GB | 2171077 | | | 8/1986 |
| GB | 2266513 | | | 11/1993 |
| GB | 2276095 | A | | 9/1994 |
| GB | 2335652 | A | | 9/1999 |
| GB | 2339187 | A | | 1/2000 |
| JP | 57163658 | | | 10/1982 |
| JP | S822411 | B2 | | 2/1983 |
| JP | 6080405 | | | 5/1985 |
| JP | 62171479 | | | 10/1987 |
| JP | 63022370 | | | 1/1988 |
| JP | 01167084 | A | | 6/1989 |
| JP | 01226579 | A | | 9/1989 |
| JP | 01267182 | A | | 10/1989 |
| JP | 04044968 | A | * | 2/1992 |
| JP | H0581083 | | | 11/1993 |
| JP | 09142551 | A | | 6/1997 |
| JP | 09150872 | | | 6/1997 |
| JP | H09156677 | A | | 6/1997 |
| JP | 1059441 | | | 3/1998 |
| JP | 10059441 | | | 3/1998 |
| JP | 10120016 | A1 | | 5/1998 |
| JP | 10129685 | | | 5/1998 |
| JP | H10167355 | | | 6/1998 |
| JP | H10152179 | A | | 9/1998 |
| JP | H10509406 | | | 9/1998 |
| JP | H0444968 | | | 2/1999 |
| JP | 11198977 | | | 7/1999 |
| JP | H11343468 | | | 12/1999 |
| JP | 2000335542 | A | | 12/2000 |
| JP | 2001114357 | | | 4/2001 |
| JP | 768679 | | | 6/2001 |
| JP | 2001301807 | | | 10/2001 |
| JP | 2002002805 | A | | 1/2002 |
| JP | 2002104550 | A | | 4/2002 |
| JP | 200326224 | | | 1/2003 |
| JP | 2003026224 | A | | 1/2003 |
| JP | 2003072774 | | | 3/2003 |
| JP | 2003137314 | | | 5/2003 |
| JP | 2005015015 | | | 1/2005 |
| JP | 200602767 | | | 2/2006 |
| JP | 2006062712 | | | 3/2006 |
| JP | 2006137445 | A | | 6/2006 |
| JP | 2006199343 | | | 8/2006 |
| JP | 2007045434 | | | 2/2007 |
| JP | 2008105751 | | | 5/2008 |
| JP | 2009166870 | | | 7/2009 |
| NZ | 555274 | | | 12/2008 |
| WO | 8606350 | | | 11/1986 |
| WO | 9104920 | | | 4/1991 |
| WO | 9411270 | A1 | | 5/1994 |
| WO | 1994011270 | | | 5/1994 |
| WO | 9424019 | A2 | | 10/1994 |
| WO | 9532902 | A1 | | 12/1995 |
| WO | 9725200 | | | 7/1997 |
| WO | 1997025200 | | | 7/1997 |
| WO | 0061458 | A | | 10/2000 |
| WO | 0064755 | | | 11/2000 |
| WO | 0140073 | A1 | | 6/2001 |
| WO | 02066341 | | | 8/2002 |
| WO | 2002064365 | A1 | | 8/2002 |
| WO | 03013976 | A1 | | 2/2003 |
| WO | 03037727 | | | 5/2003 |
| WO | 2003035504 | | | 5/2003 |
| WO | 03059776 | A1 | | 7/2003 |
| WO | 2004087527 | A1 | | 10/2004 |
| WO | 2005054079 | | | 6/2005 |
| WO | 2005056420 | | | 6/2005 |
| WO | 2005110042 | | | 11/2005 |
| WO | 2005110865 | | | 11/2005 |
| WO | 2005110876 | | | 11/2005 |
| WO | 2005110885 | A2 | | 11/2005 |
| WO | 2005120989 | | | 12/2005 |
| WO | 2005123535 | A1 | | 12/2005 |
| WO | 2005254459 | | | 12/2005 |
| WO | 2006055128 | A2 | | 5/2006 |
| WO | 2006080405 | | | 8/2006 |
| WO | 2006108614 | | | 10/2006 |
| WO | 2007079071 | A1 | | 7/2007 |
| WO | 2007090419 | | | 8/2007 |
| WO | 2008051813 | | | 5/2008 |
| WO | 2008062159 | A1 | | 5/2008 |
| WO | 2008074060 | | | 6/2008 |
| WO | 2008108969 | | | 9/2008 |
| WO | 2008115693 | A1 | | 9/2008 |
| WO | 2008122961 | | | 10/2008 |
| WO | 2008146142 | | | 12/2008 |
| WO | 2009065120 | | | 5/2009 |
| WO | 2009111153 | | | 9/2009 |
| WO | 2010002834 | | | 1/2010 |

(56) References Cited

FOREIGN PATENT DOCUMENTS

| | | | |
|---|---|---|---|
| WO | 2010046623 | | 4/2010 |
| WO | 2010051146 | A2 | 5/2010 |
| WO | 2010080810 | | 7/2010 |
| WO | 2010084336 | A1 | 7/2010 |
| WO | 2010088492 | A1 | 8/2010 |
| WO | 2010114879 | A1 | 10/2010 |
| WO | 2010149996 | A1 | 12/2010 |
| WO | 2011004156 | A2 | 1/2011 |
| WO | 2011032064 | | 3/2011 |
| WO | 2011121337 | A2 | 10/2011 |
| WO | 2011123410 | | 10/2011 |
| WO | 2011146616 | | 11/2011 |
| WO | 2011146627 | | 11/2011 |
| WO | 2011146658 | | 11/2011 |
| WO | 2012036765 | | 3/2012 |
| WO | 2012098412 | | 7/2012 |

OTHER PUBLICATIONS

'Cheese Range', Mintel gnpd, Jan. 26, 2001, Mintel Publishing, 1 page.
'Elite Edam Cheese', Mintel gnpd, Dec. 3, 2001, Mintel Publishing, 2 pages.
'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.
'New Easy Peel Cheese Packaging', Mintel gnpd, Aug. 10, 2001, Mintel Publishing.
'New on the Shelf-Product Instructions and Packaging Trends', Circle Reader Service Card No. 93, Aug. 1998, Baking & Snack.
'Soft Bread Sticks', Mintel gnpd, Mar. 20, 1998, Mintel Publishing, 1 page.
"Wall's Bacon" A Sizzling Success Story and the Grocer: "When sealed delivers", the second page of which bears a date of Aug. 21, 1999.
40 Packaging News PPMA Preview Sep. 2001.
Defendants' Answer, Affirmative Defenses, and Counterclaims Responsive to Complaint, dated Apr. 5, 2012, 25 pages.
Defendants' Final Invalidity Contentions—Exhibit A-1, dated Sep. 27, 2013, 55 pages.
Defendants' Final Invalidity Contentions—Exhibit A-2, dated Sep. 27, 2013, 35 pages.
Defendants' Final Invalidity Contentions—Exhibit A-3, dated Sep. 27, 2013, 34 pages.
Defendants' Final Invalidity Contentions—Exhibit A-4, dated Sep. 27, 2013, 35 pages.
Defendants' Final Invalidity Contentions—Exhibit B-1, dated Sep. 27, 2013, 135 pages.
Defendants' Final Invalidity Contentions—Exhibit B-2, dated Sep. 27, 2013, 64 pages.
Defendants' Final Invalidity Contentions—Exhibit B-3, dated Sep. 27, 2013, 140 pages.
Defendants' Final Invalidity Contentions—Exhibit B-4, dated Sep. 27, 2013, 273 pages.
Defendants' Final Invalidity Contentions—Exhibit B-5, dated Sep. 27, 2013, 146 pages.
Defendants' Final Invalidity Contentions—Exhibit B-6, dated Sep. 27, 2013, 226 pages.
Defendants' Final Invalidity Contentions Pursuant to LPR 3.1, dated Sep. 27, 2013, 22 pages.
Defendants' Final Unenforceability Contentions Pursuant to LPR 3.1, dated Sep. 27, 2013, 14 pages.
Defendants' Initial Non-Infringement Contentions Pursuant to LPR 2.3(a), dated May 17, 2013, 7 pages.
Defendants' Invalidity Contentions—Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' Invalidity Contentions—Exhibit A-5, dated May 17, 2013, 39 pages.
Defendants' Invalidity Contentions Pursuant to LPR 2.3, dated May 17, 2013, 23 pages.
Defendants' LPR 2.3 Initial Non-Infringement Contentions Exhibit A, dated May 17, 2013, 39 pages.
Defendants' Supplemental Memorandum of Law Regarding Additional Claim Construction Authority Requested by the Court, dated Feb. 28, 2014, 13 pages.
Defendants' Unenforceability Contentions Pursuant to LPR 2.3, dated May 17, 2013, 13 pages.
English Translation of JP H09-156677 published on Jun. 17, 1997, 2 pages.
Machine translation of claim for BR 5500885-2 from Googletranslate.com; 1 page.
Machine translation of claim for BR 6202030-7 from Googletranslate.com; 1 page.
Machine translation of claim for BR 6804636-7 from Googletranslate.com; 1 page.
English Translation of Japanese Official Notice of Rejection dated Feb. 14, 2012 in JP Application No. 2009-172352, citing Japanese Laid Open Application No. 62-171479, 3 pages.
English Translation of Japanese Unexamined Application Publication No. H9-156677, published Jul. 17, 1997; 6 pages.
English Translation of JP 1998-152179 (H10-152179 A), published on Sep. 6, 1998, 6 pages.
English Translation of JP 2001-114357 published on Apr. 24, 2001, 8 pages.
English Translation of JP 2003-26224 published on Jan. 29, 2003, 13 pages.
English Translation of JP Official Notice of Rejection dated Jan. 29, 2013 in JP Appl. No. 2008-087152 citing JPH0581083, 5 pages.
European Packaging Pack Report, NR. Mai 5, 2001 and partial translation thereof, 6 pages.
European Search Report, EP10305289 citing DE1848870U, 3 pages.
European Search Report 06118142.6 dated May 3, 2007, citing DE90140656, 10 pages.
Fuji Packaging GmbH Fachpack brochure, Oct. 11-12, 2001; 2 pages.
Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' Lpr 2.5 Initial Response to Defendants' Initial Invalidity Contentions Chart Ex. A-5, dated May 31, 2013, 14 pp.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Kellogg's Opening Claim Construction Brief, dated Dec. 13, 2013, 30 pages.
Kellogg's Reply Claim Construction Brief, dated Jan. 24, 2014, 19 pages.
Kellogg's Response to Plaintiff's Surreply Claim Construction Brief Pursuant to Docket No. 98, dated Feb. 28, 2014, 9 pages.
Machine translation of CN 1781819A published Jun. 7, 2006 from google.com/patents; 13 pages, accessed Jun. 5, 2014.

(56) References Cited

OTHER PUBLICATIONS

Machine translation of DE 202007005487, published Jun. 14, 2007, provided by Espacenet, 3 pages.
Machine translation of DE 202009000302, published Mar. 19, 2009, provided by Espacenet, 9 pages.
Machine translation of DE9014065, published Mar. 19, 2009, provided by Espacenet, 9 pages.
Machinery Update, Mar./Apr. 2002, pp. 56-62.
Machinery Update, Mar./Apr. 2002, pp. 59-60.
Machinery Update, Sep./Oct. 2001, pp. 46-47.
Opposition to EP1679269 filed by Awapatent AB, Helsingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, citing DE9003401 and DE9005297, 9 pages.
Patent Abstracts of Japan, vol. 1997 No. 10, Oct. 31, 1997 and JP09156677 A (Fuji Seal Co. Ltd.) (Jun. 17, 1997) abstract in English and 7 figures.
Plaintiffs Initial Response to Defendants Initial Invalidity Contentions, dated May 31, 2013, 20 pages.
Plaintiff Intercontinental Great Brands LLC's Responsive Claim Construction Brief Pursuant to LPR 4.2, dated Feb. 10, 2014, 27 pages.
Plaintiff Intercontinental Great Brands LLC's Submission of Authority Pursuant to Docket No. 98, dated Feb. 28, 2014, 11 pages.
Plaintiff Intercontinental Great Brands LLC's Surreply Claim Construction Brief Pursuant to Docket No. 98, dated Feb. 21, 2014, 6 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reseal-It. Web page Internet print out accessed Mar. 14, 2005; 19 pages.
U.S. District Court for the Northern District of Illinois, Eastern Division Memorandum Opinion and Order, dated Sep. 22, 2014, 12 pages.
Additional Exhibits from Declaration of James Lukas Jr. filed Mar. 26, 2015, 73 pages.
Declaration of James J. Lukas, Jr. In Support of Defendants' Motion for Summary Judgment with Exhibits, Part 1 dated Mar. 23, 2015, 277 pages.
Declaration of James J. Lukas, Jr. In Support of Defendants' Opposition to Plaintiff's Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Consolidated Memorandum in Support of Motion for Summary Judgment (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Local Rule 56.1 Statement of Material Facts in Support of Motion for Summary Judgment (redacted), dated Mar. 23, 2015, 75 pages.
Defendants' LR 56.1 (b) (3) (C) Statement of Additional Material Facts in Support of Their Opposition to Plaintiffs Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 and/or 103, dated Mar. 23, 2015, 4 pages.
Defendants' Motion to Compel Discovery, dated Oct. 13, 2014, 3 pages.
Defendants' Response to Plaintiff's Local Rule 56.1 Statement of Material Facts in Support of Plaintiff's Motions for Summary Judgment, dated May 28, 2015, 108 pages.
Exhibits, part 2, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted),dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted),dated May 8, 2015, 136 pages.
Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.
Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Machine Translation of EP 1449789 description. Translated on Jun. 13, 2015, 18 pages.
Defendant's Local Rule 56.1 Statement of Material Facts in Support of Motion for Summary Judgment, dated Mar. 23, 2015, 75 pages.
Exhibits, part 2, to Declaration of James J. Lukas, Jr. in Support of Defendants' Motion for Summary Judgment, dated Mar. 23, 2015 125 pages.
Exhibits, part 3, to Declaration of James J. Lukas, Jr. in Support of Defendants' Motion for Summary Judgment, dated Mar. 23, 2015, 125 pages.
Exhibits, part 4 to Declaration of James J. Lukas, Jr. in Support of Defendants' Motion for Summary Judgment with Exhibits, dated Mar. 23, 2015, 28 pages.
English Translation of JP H09-156677 published Jun. 17, 1995; 8 pgs.
English Translation of JP2006137445 filed by Shimomura, published Jun. 1, 2006, translation provided by the USPTO in U.S. Appl. No. 13/698,567, 18 pages.
U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the USPTO in U.S. Appl. No. 11/193,614.
English Translation of JP2003-026224, translated on Jul. 27, 2015. Translation provided by USPTO in U.S. Appl. No. 14/175,434, 9 pages.

(56) References Cited

OTHER PUBLICATIONS

English Translation of JP2001-301807, translated on Jul. 27, 2015. Translation provided by USPTO in U.S. Appl. No. 14/175,434, 6 pages.
Machine Translation of the description of DE 3835721. Translation provided by USPTO in U.S. Appl. No. 14/005,783, dated Jan. 21, 2016, 17 pages.
Definition of "end." Webster's New World Dictionary, Third College Edition. 1988 Simon & Schuster, cited by USPTO in U.S. Appl. No. 11/193,614, dated Jan. 21, 2016, 3 pages.
Non-Confidential Brief for Plaintiff—Appellant Intercontinental Great Brands LLC, dated Dec. 30, 2015, 149 pages, filed with the Federal Circuit in Case Nos. 2015-2082, -2084 (litigation related to U.S. Pat. No. 6,918,532).
European Extended Search Report for Application No. 16180214.5, dated Sep. 26, 2016, 7 pages.
Non-Confidential Responsive/Reply Brief for Plaintiff—Appellant Intercontinental Great Brands LLC, dated Sep. 30, 2016; 69 pages, filed with the Federal Circuit in Case Nos. 2015-2082, -2084.
Brief of Defendants—Cross-Appellants; dates Jun. 17, 2016; 86 pages, filed with the Federal Circit in Case Nos. 2015-2082, -2084.
Reply Brief of Defendants—Cross-Appellants; dated Oct. 14, 2016, 37 pages, filed with the Federal Circuit in Case Nos. 2015-2082, -2084.

* cited by examiner

PACKAGE INTEGRITY INDICATING CLOSURE

CROSS-REFERENCE TO RELATED APPLICATIONS

This application is a continuation of U.S. patent application Ser. No. 13/669,811, filed Nov. 6, 2012, which is a continuation of U.S. patent application Ser. No. 11/693,751, filed Mar. 30, 2007, now U.S. Pat. No. 8,408,792, which are both hereby incorporated by reference herein in their entireties.

FIELD OF THE INVENTION

The present invention relates to a resealable closure for packages storing articles and, more particularly, such resealable closures having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532 (hereinafter "the '532 patent"), herein incorporated by reference, which discloses a wrapper which forms a top of the container, which top has an access opening covered by a resealable sealing panel.

In the packaging art, different structures have been used to indicate whether a package has been previously opened or whether the integrity of the package has been compromised, which structures are often referred to in the art as "tamper-evident." For example, one recent package integrity indicating closure is disclosed in U.S. patent application Ser. No. 11/500,497 hereinafter the '497 application and incorporated by reference, which shows a closure comprising a two-ply material having an inner film layer and an outer film layer forming a top of a container. The outer film layer has a sealing panel covering a portion of the inner film layer which, with the sealing panel, forms an opening. The package integrity feature comprises a panel of the inner film layer which separates from the sealing panel to indicate that the closure has been previously opened.

There is a need for improvement in the art of package integrity indicators for a resealable closure, preferably suitable for use with a resealable closure for containers or packages containing food items.

SUMMARY OF THE INVENTION

The present invention generally relates to a resealable closure for a container in which package integrity is indicated by a frangible or breakable structure which breaks and/or produces an audible sound when the resealable closure is opened for a first time.

The present invention, in one form, comprises a package integrity feature having a structure associated with a resealable closure. The structure preferably produces an audible sound when the resealable closure is opened for a first time. In one form, the structure comprises at least one strip initially affixed to a stationary and a movable portion of the resealable closure so that upon opening the resealable closure for a first time, at least one of the strips breaks, preferably producing the audible sound. The strips may include a weakened portion such as a narrowing at one location along its length. Integrity of the package is indicated by an intact strip viewable upon opening the resealable closure and conversely, a broken or non-intact strip would indicate that the resealable closure has been previously opened.

In a further form, package integrity is evidenced by a see-through window in the resealable closure so that a portion is visible therethrough prior to the closure being opened for a first time, but not visible therethrough after the closure has been opened for a first time and resealed. This portion may be one of the strips or it may be a second panel which is separate from the strips.

In another further form, the structure comprises at least two strips, wherein at least one strip will break at a different time than another one or more strips upon opening the resealable closure, thereby preferably producing at least two separate audible sounds as each strip breaks.

The package integrity feature may comprise a closure for a package having a top, an access opening in the top and a sealing panel which covers the access opening and sealingly engages the top around the access opening so as to originally seal the package and then, after having been opened a first time, be resealable against the top. A structure is associated with the resealable closure which preferably produces an audible sound when the resealable closure is opened for a first time. Advantageously, the structure produces an audible sound prior to being able to remove an item contained within the package.

The present invention, in another form, relates to a package integrity indicating closure comprising a film layer forming the top of a container and having a flap defining an access opening to gain access to the contents of the container and having at least one strip joining the flap to a remaining portion of the top. A sealing panel completely covers the flap including the at least one strip of the film layer. A releasable adhesive provided on either or both the sealing panel or on the film layer adheres the sealing panel to the film layer. The sealing panel is releasable from the film layer by pulling the sealing panel back in a peeling direction and is reclosable against the top to seal the access opening when the sealing panel is moved back against the top. Upon peeling the sealing panel back for a first time, the at least one strip joining the flap to the top breaks.

The package integrity indicating closure may also comprise at least a two-ply material comprising an inner layer adhesively joined to an outer layer and, together, forming a top of the container. The inner layer has a first panel, a second panel, and at least one strip joining the first panel to a remaining portion of the top of the container. The outer layer has a sealing panel formed therein which completely covers the first panel, covers the strip and covers the second panel of the inner layer. The first panel and the sealing panel are permanently joined to each other to provide an access opening into the container. A releasable adhesive provided around a perimeter of the sealing panel adheres the sealing panel to the inner layer and the second panel. The sealing panel is releasable from the inner layer and is separable from the second panel by pulling the sealing panel back in a peeling direction and reclosable against the top to seal the opening when the sealing panel is moved back against the top. Upon opening the closure for a first time, the at least one strip between the first panel and the remaining portion of the top of the container breaks. After closing, the second panel is separated from the sealing panel. Advantageously, in one form, the at least one strip is integrally formed with the inner layer.

Package integrity may also be indicated by misalignment of sealing panel holes with tab portions after the sealing panel has been opened and resealed.

Food items disposed in the container may include but are not limited to cookies, crackers, peanuts, cheese, sliced meats, and semi-solid foods.

Other features and advantages of the present invention are stated in or apparent from detailed descriptions of the presently preferred embodiments of the invention found herebelow.

DETAILED DESCRIPTION

Figure 1:
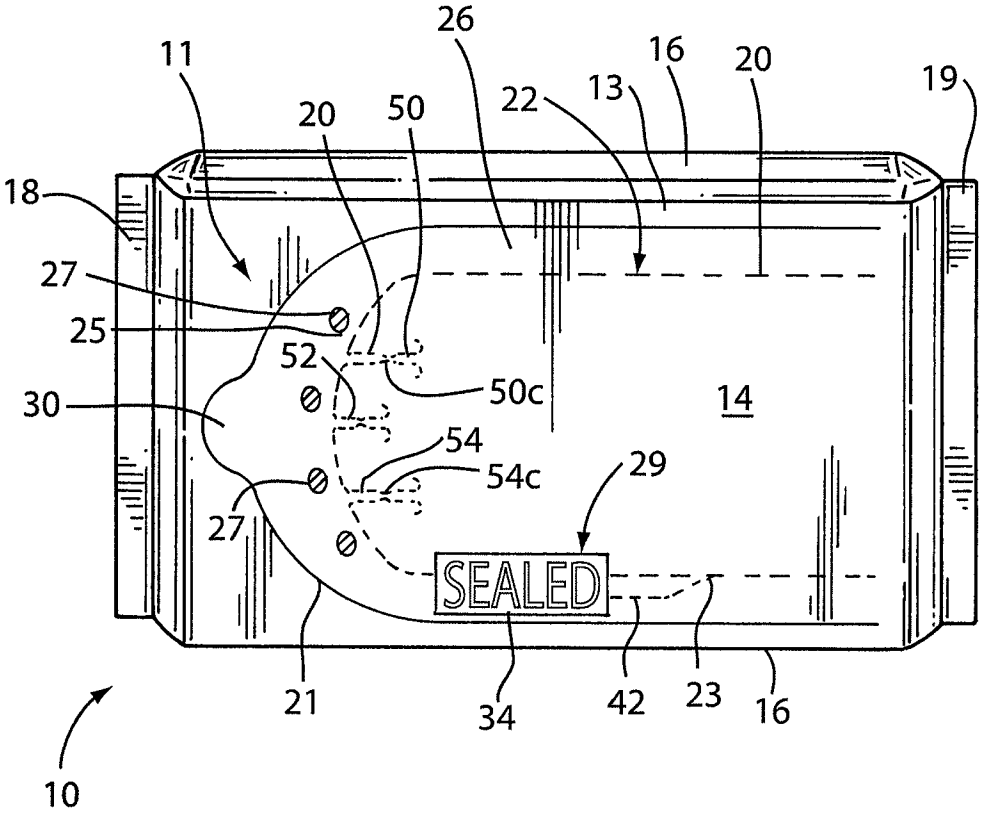
FIG. 1 is a perspective view of a package including an exemplary closure prior to an initial opening, according to the present invention.

Referring to the figures and, in particular, FIGS. 1-4, there is shown package 10 with closure 11, which incorporates a package integrity feature. Package 10 includes a two-ply wrapper comprising a first, inner film layer 12 and a second, outer film layer 13, forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of the package 10, the first, inner film layer 12 is die cut on its side via first tear line 20, which includes all of the dashed lines in FIG. 1, other than second tear line 23. Outer film layer 13 is die cut on its side via a third tear line 21 and die cuts 25. Inner and outer tear lines are disclosed in U.S. Patent Application Publication No. 2005/0276525, herein incorporated by reference.

The first tear line 20 is formed as a continuous tear line to define a first panel 22. The first tear line 20 also defines a plurality of strips 50, 52, 54. A second tear line 23 forms a second panel 42 which also serves to indicate package integrity.

Figure 2A:
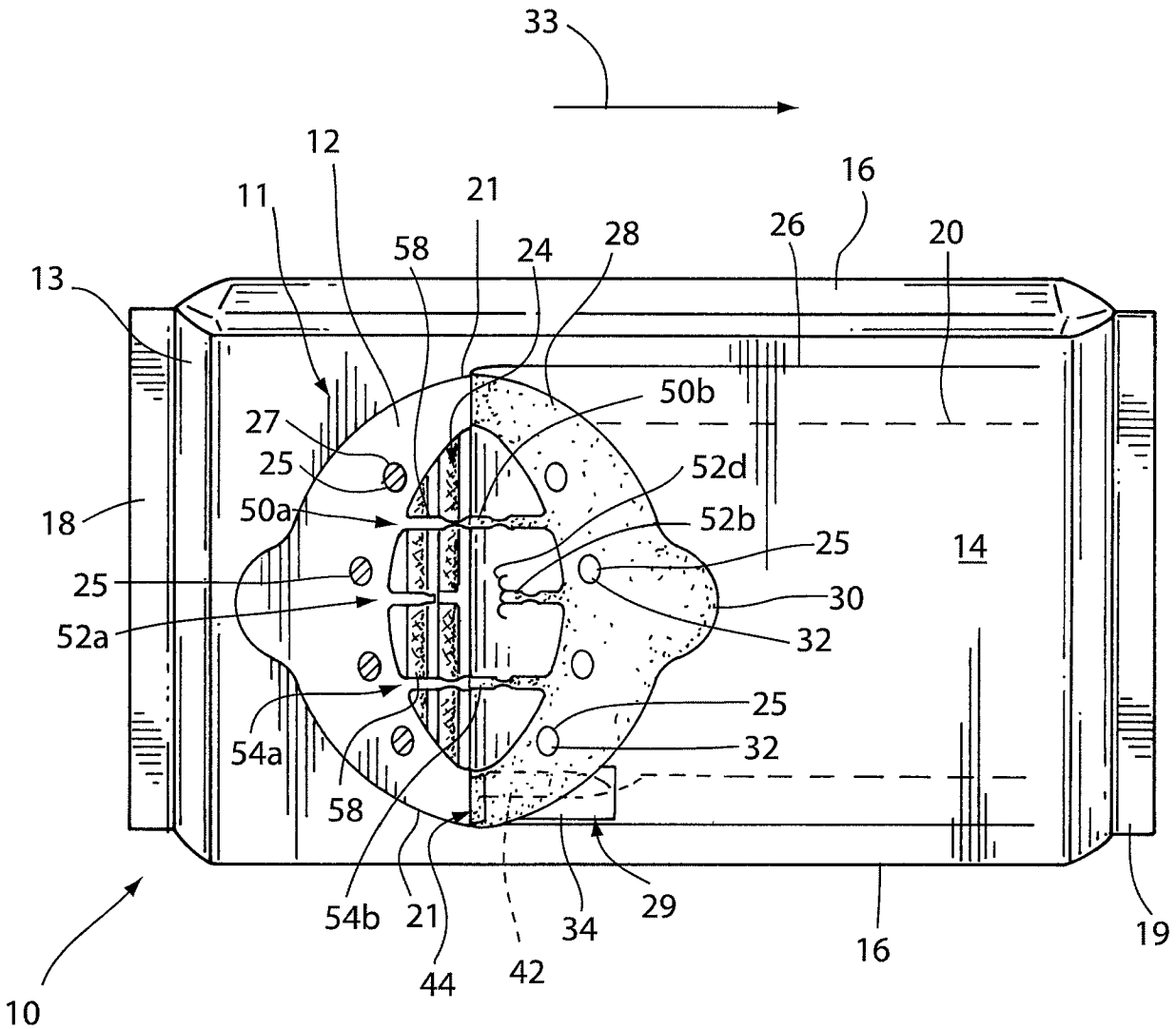
FIG. 2*a* is the package of FIG. 1, shown in a first partially opened condition.
Figure 2B:
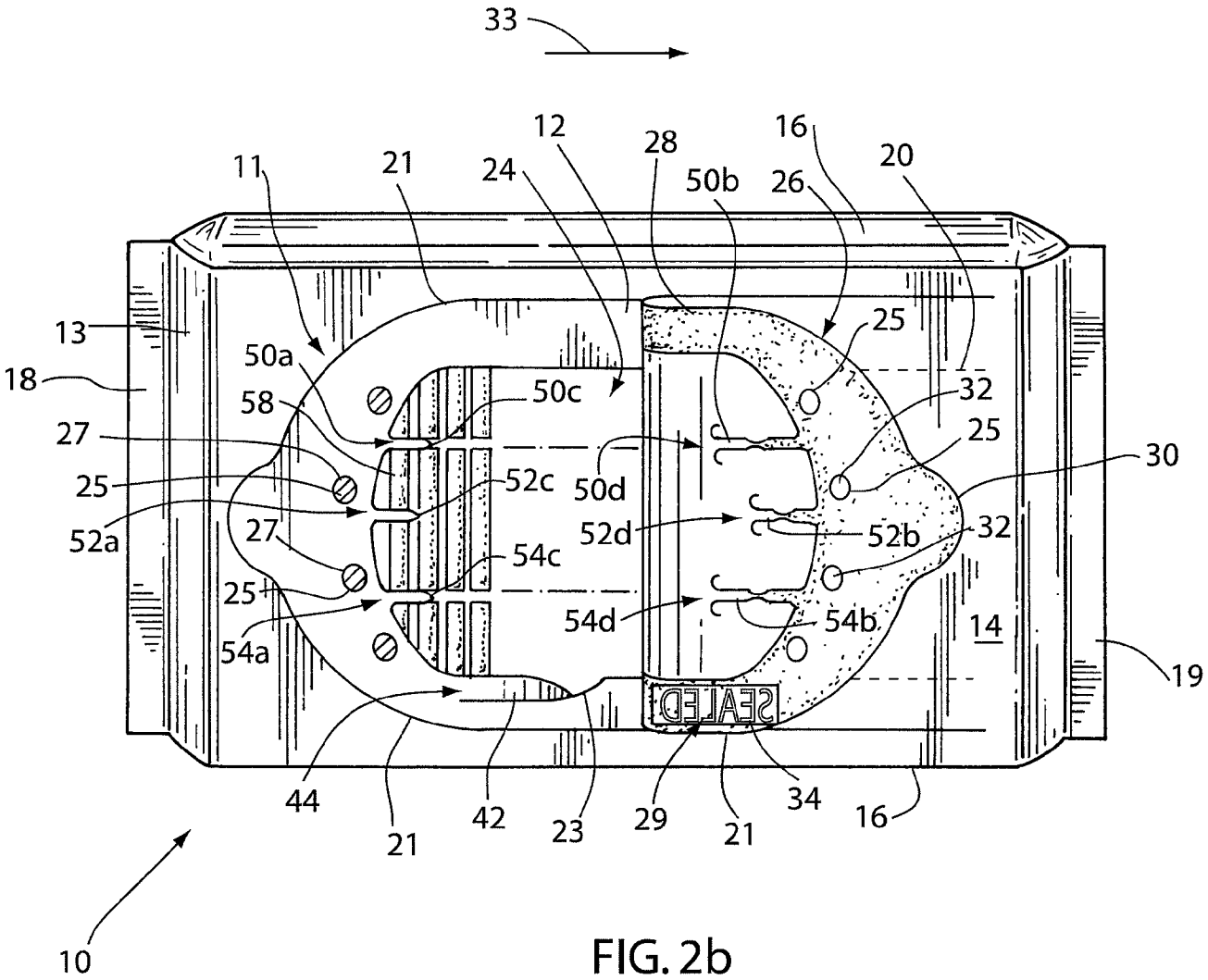
FIG. 2*b* is the package of FIG. 1, shown in a further partially opened condition relative to that of FIG. 2*a;*

The first panel 22 can be separated from the remainder of the inner film 12 to expose an opening 24 whereby access to the contents of the package may be gained after the strips 50, 52, 54 have broken (FIG. 2*a*, 2*b*). Each strip 50, 52, 54 is integrally joined, and remains attached to the remaining portion of the inner layer 12 which comprises the top 14 at strip portions 50*a*, 52*a*, 54*a*, respectively, and a portion of the strips 50, 52, 54 remains integrally attached to the first panel 22 at strip portions 50*b*, 52*b*, 54*b*, respectively. Each strip 50, 52, 54 has a weakened portion defined by a narrowing in the width of the strip at portions 50*c*, 52*c*, 54*c*, respectively. The narrowing portions 50*c*, 52*c*, 54*c* provide an area of weakness to the respective strip 50, 52, 54 whereby the respective strip breaks at the narrowing portions 50*c*, 52*c*, 54*c* upon opening the closure 11 for a first time.

Strip portions 50*b*, 52*b*, 54*b* are integrally joined to the first film layer flap 22 at strip ends 50*d*, 52*d*, 54*d*, respectively. Advantageously, die cut 20 forms the strip ends 50*d*, 52*d*, 54*d* in the shape of parallel "U"'s which help ensure that the strips 50, 52, 54 will not tear at strip ends 50*d*, 52*d*, 54*d* and will remain integrally joined to the first panel 22 and allow the strips 50, 52, 54 to break at the weakened narrowing strip portions 50*c*, 52*c*, 54*c*, respectively.

The second panel 42 remains integrally joined to the inner film layer 12 at end 44, even after the package is opened, and the remainder of the second panel 42 falls down into the opening 24 as described in more detail in the '497 application.

The third tear line 21 defines sealing panel 26 of the outer film layer 13 and the die cuts 25 define a plurality of tab portions 27 in the sealing panel 26. The sealing panel 26 extends beyond the periphery of the first tear line 20 and the second tear line 23 adjacent to the opening 24, so that the sealing panel 26 completely covers and extends beyond the perimeters of the first panel 22, strips 50, 52, 54, and the second panel 42. As a result, sealing panel 26 completely covers the first panel 22, the strips 50, 52, 54, and the second panel 42.

The side of the sealing panel 26 which faces the inner film layer 12, including tab portions 27, is coated with a releasable adhesive 28 (see FIGS. 2*a*, 2*b*) so that the sealing panel 26 may be resealably secured to the inner film layer 12 at a portion adjacent the first panel 22, and so that the tab portions 27 remain permanently affixed to the inner film layer 12.

Alternatively or along with releasable adhesive 28, releasable adhesive can be coated on the inner film layer 12 along the outside perimeter of the first panel 22. The releasable adhesive can be any pressure sensitive adhesive which allows resealing and includes, but is not limited to, the adhesives disclosed in U.S. patent application Ser. No. 11/029,626, herein incorporated by reference. The sealing panel 26 is provided with a tab 30 or other gripping feature which is not coated with adhesive 28 so that the sealing panel 26 may be peeled back from the inner film layer 12 to open the package 10.

Advantageously, the sealing panel 26 has a see-through window portion 29 which lies over the second panel 42 of the inner film layer 12 prior to the package 10 being opened for a first time which permits one to visually observe the second panel 42 adhered thereto prior to the package 10 being opened for a first time and to observe the absence of the second panel 42 attached to the sealing panel 26 after the package 10 has been opened to indicate package integrity as described in the '497 application.

Figure 3:
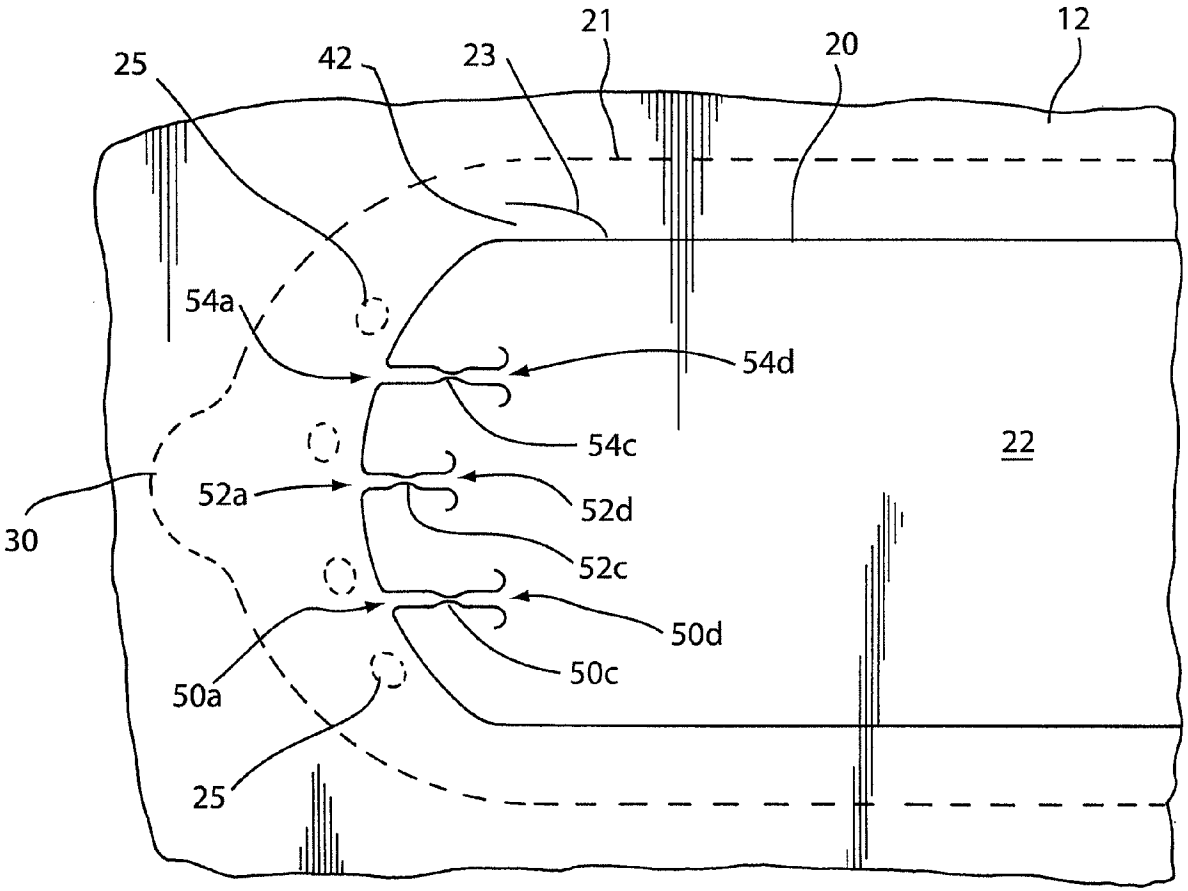
FIG. 3 is a partial plan view of the closure of FIG. 1, as viewed from below in its initial condition prior to being opened for a first time according to the present invention.

Referring now specifically to FIGS. 2*a*, 2*b* and FIG. 3, package 10 is opened by grasping tab 30 and peeling the sealing panel 26 back in the peeling direction as indicated by arrow 33 (FIGS. 2*a*, 2*b*). As the sealing panel 26 is peeled back for a first time, the first panel 22 is separated from the remainder of the inner film layer 12, including the second panel 42 and a portion of the strips 50, 52, 54, along the first film layer tear line 20. Strip portions 50*a*, 52*a*, 54*a* remain integrally attached to the remaining portion of the inner film layer 12, and strip portions 50*b*, 52*b*, 54*b* remain integrally attached to the first panel 22 (FIG. 3). In addition, tab portions 27 separate from sealing panel 26 and remain attached to the inner film layer 12 due to adhesive 28, to thereby form holes 32 in the sealing panel 26 (FIGS. 2 and 3).

Initially, upon opening the closure 11, the strip portions 50*a*, 52*a*, 54*a* separate from the sealing panel 26 while strip portions 50*b*, 52*b*, 54*b* remain attached to the sealing panel 26 as shown in FIG. 2*a*. At some point upon peeling the sealing panel 26 back, strip 52 preferably first breaks at narrowing strip portion 52*c* while strips 50 and 54 remain intact (FIG. 2*a*). When strip 52 breaks, an audible sound, such as a snap is produced. As shown in FIGS. 2*a* and 2*b*, the strips may be spaced apart a distance less than the largest dimension of the contents, shown for example in FIGS. 2*a* and 2*b* as a cookie 58, so that in practice before strip 52 has been broken, the spacing between the strip is too small for removal of a cookie 58.

Pulling the sealing panel 26 further in direction of arrow 33 further opens the closure 11 and eventually strips 50 and 54 break at narrowing strip portion 50*c*, 54*c*, respectively. As each strip breaks an audible sound such as a snap occurs. Advantageously, the strip narrowing portion 50*c*, 54*c* are at the respective same position along the strip 50, 54 so that the strips 50 and 54 break at the same time, thereby producing a unified or single audible sound. Since strip 52 breaks prior to strips 50, 54, two audible sounds are produced, one upon strip 52 breaking, and a second one as strips 50 and 54 break simultaneously.

Package integrity is indicated by closure 11 through several novel features incorporated into the closure 11. Package integrity is indicated visually by one observing the intact integrally joined strips 50, 52, 54 which advantageously break upon opening the closure 11 a sufficient amount prior to allowing one to remove contents therein thereby indicating package integrity. Further, package integrity is indicated by audible sounds produced when the strips break, whereby the audible sound indicates that the package is being opened for a first time.

In addition, package integrity is indicated by the visual indication of a portion 34 of the sealing panel 26, shown as black outlined letters for the word "SEALED," and a portion 36 of the inner film layer 12 spanning a portion of the panel 22, shown as being gray, which is viewable through the window portion 29 prior to the closure 11 being opened for a first time (FIG. 1), and a middle portion of the word "SEALED" having a void 46 which void exists because the second panel 42, which was present and intact before the package was opened the first time, has now fallen down in the package and is not visible in the void area 46. The void area 46 is thus shown as not shaded after the closure has been opened and resealed (FIG. 4).

Figure 4:
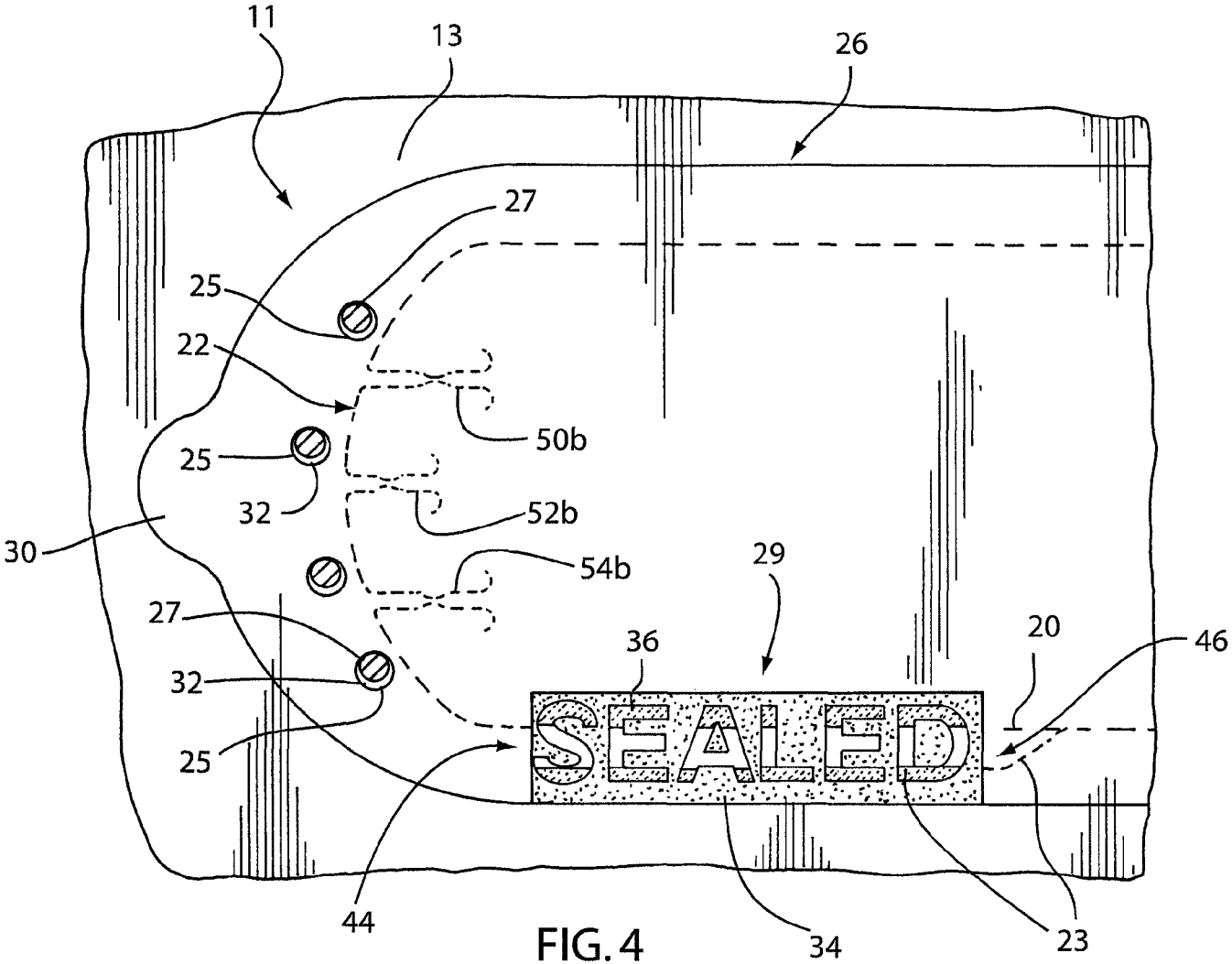
FIG. 4 is a partial plan view of the closure of FIG. 1, after an initial opening and reseal, according to the present invention.

Further, since the sealing panel 26 does not generally return to its exact original position, but instead is slightly misaligned relative to its original position, package integrity is indicated by such misalignment of the sealing panel holes 32 with the tab portions 25 after the sealing panel 26 has been opened and resealed (FIG. 4).

Figure 5:
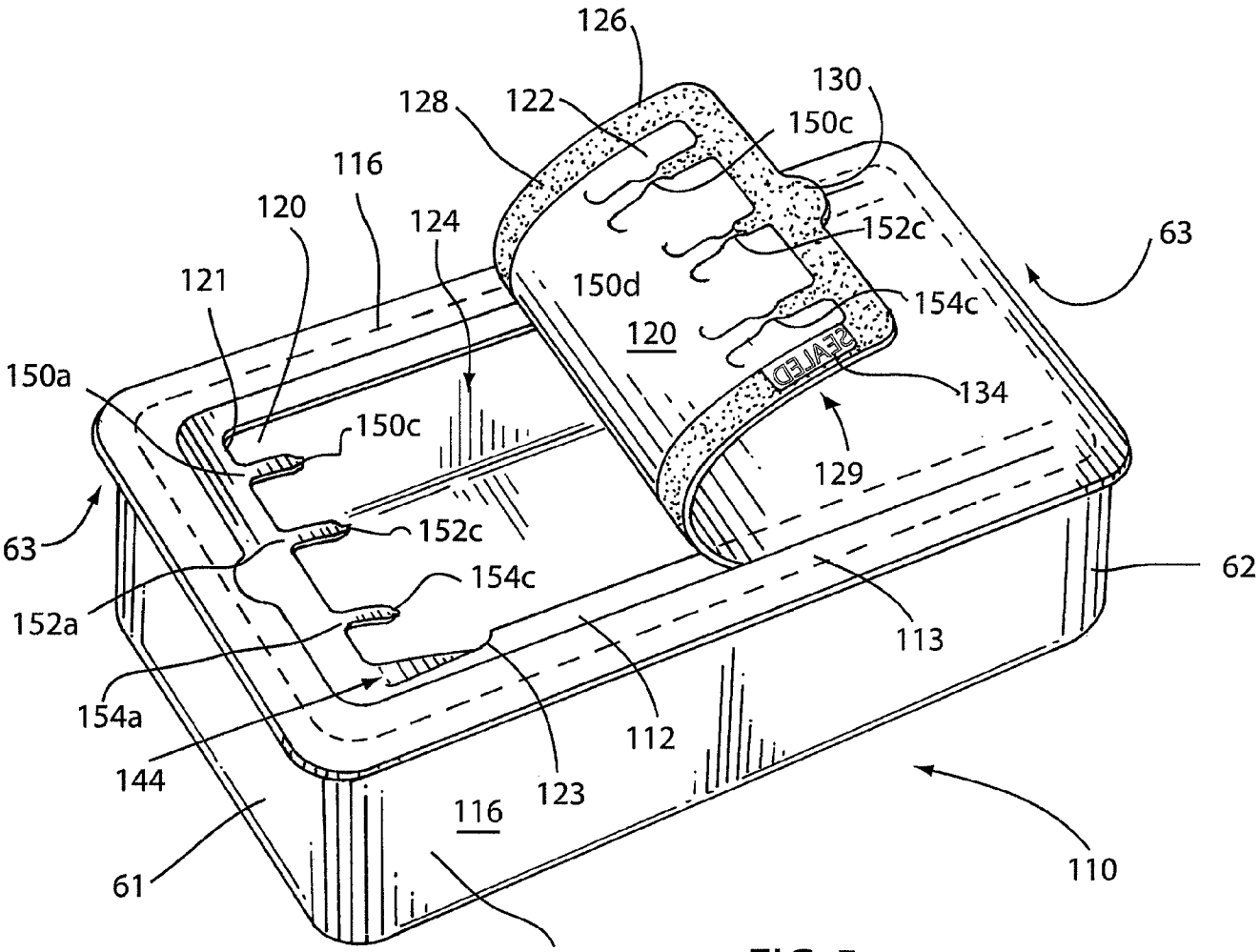
FIG. 5 is a perspective view of another package, including a closure that has been opened, in accordance with the present invention.

Referring to FIG. 5, like elements to those of the embodiment of FIGS. 1-4 are increased by 100. Package 110 comprises a thermal formed tray 60 which forms the sides 116 and ends 61, 62. A two-ply film material comprising an inner film layer 112 and a outer film layer 113 are sealed to flange 63 of the thermal formed tray 60. Like package 10, pulling back on tab 130 separates the sealing panel 126 from the outer film layer 113 and separates the first panel 122 from the inner film layer 112, portions of the strips 150, 152, 154 and the second panel 142. After package 110 has been opened for a first time, the strips 150, 152, 154 will break at narrowing strip portions 150*c*, 152*c*, 154*c* producing an audible sound upon breaking and providing a visual indication of package integrity status that the package has been previously opened as shown in FIG. 5.

Package 110 can be used for various food items, such as cheese, sliced meats and the like. In addition, package 110 can be used for semi-solid items, such as pudding and yogurt. Although package 110 is depicted as having a rectangular shape, the package 110 can have any shape, including cylindrical and irregular.

The inner and outer film layers 112, 113 may be formed of the same material as layers 12, 13, which includes polypropylene, polyethylene, cellophane or any other polymeric material suitable for forming a package enclosure.

Figure 6:
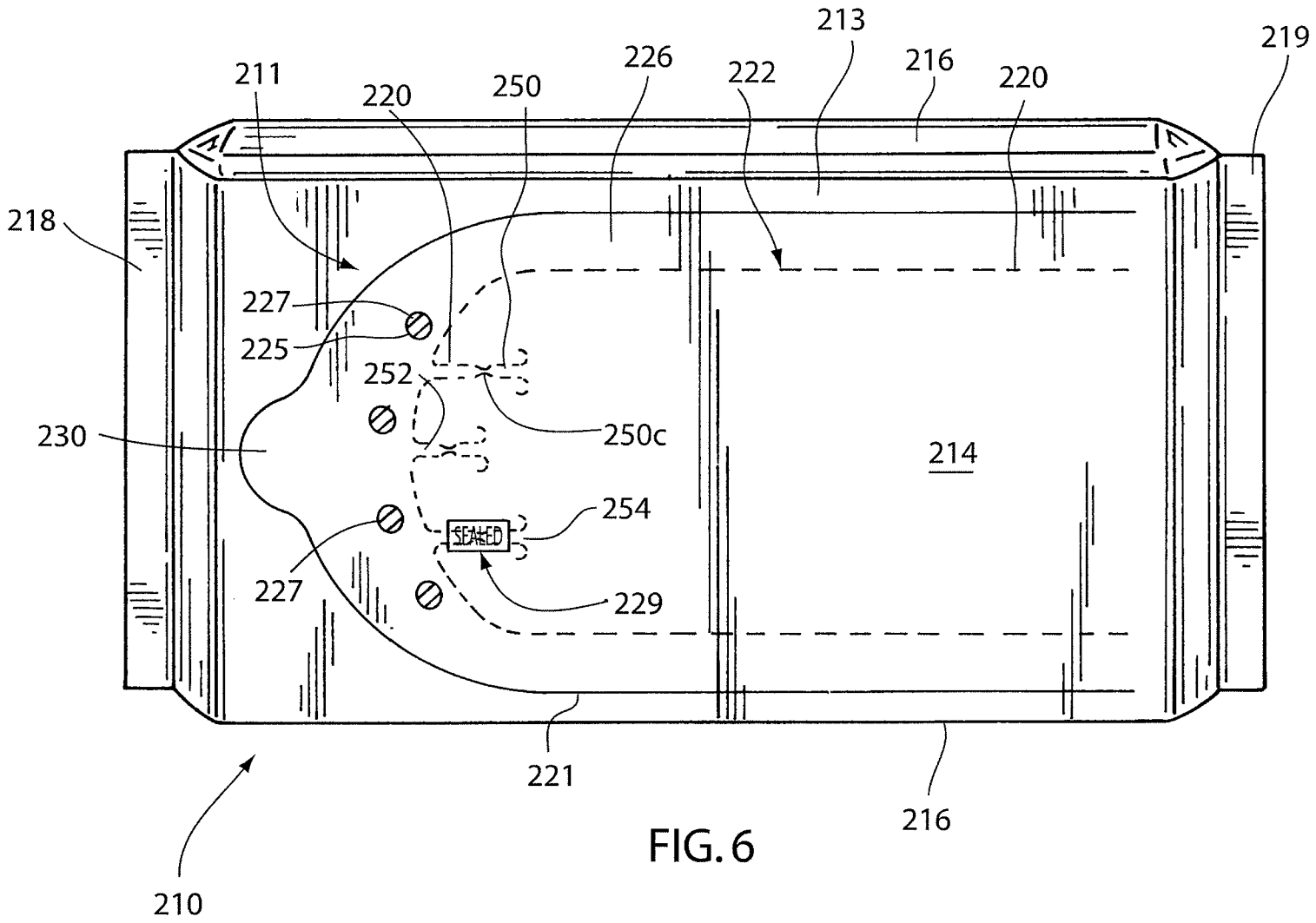
FIG. 6 is a perspective view of another package, including another closure prior to an initial opening, according to the present invention.
Figure 7:
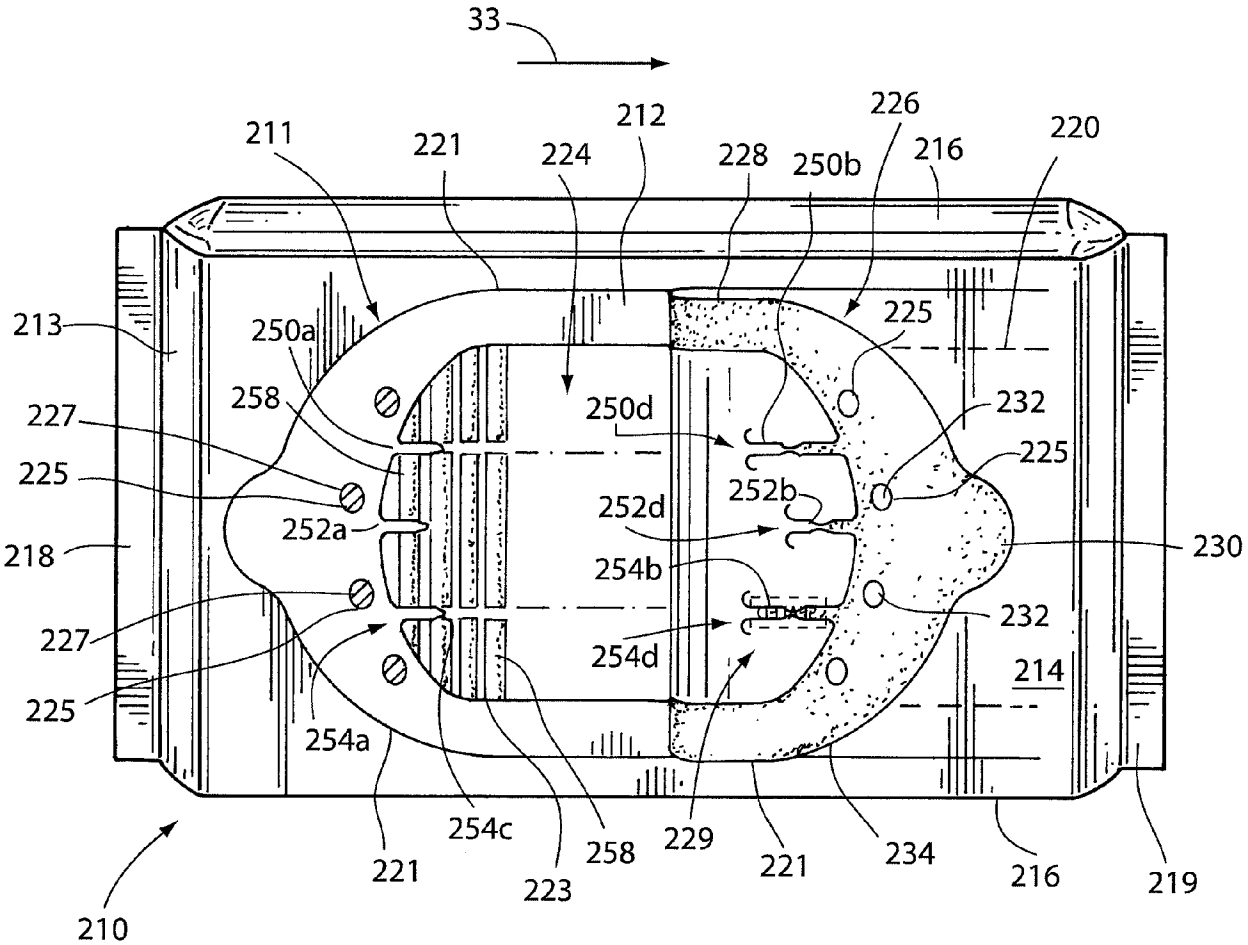
FIG. 7 is the package of FIG. 6, shown in a partially opened condition.
Figure 8:
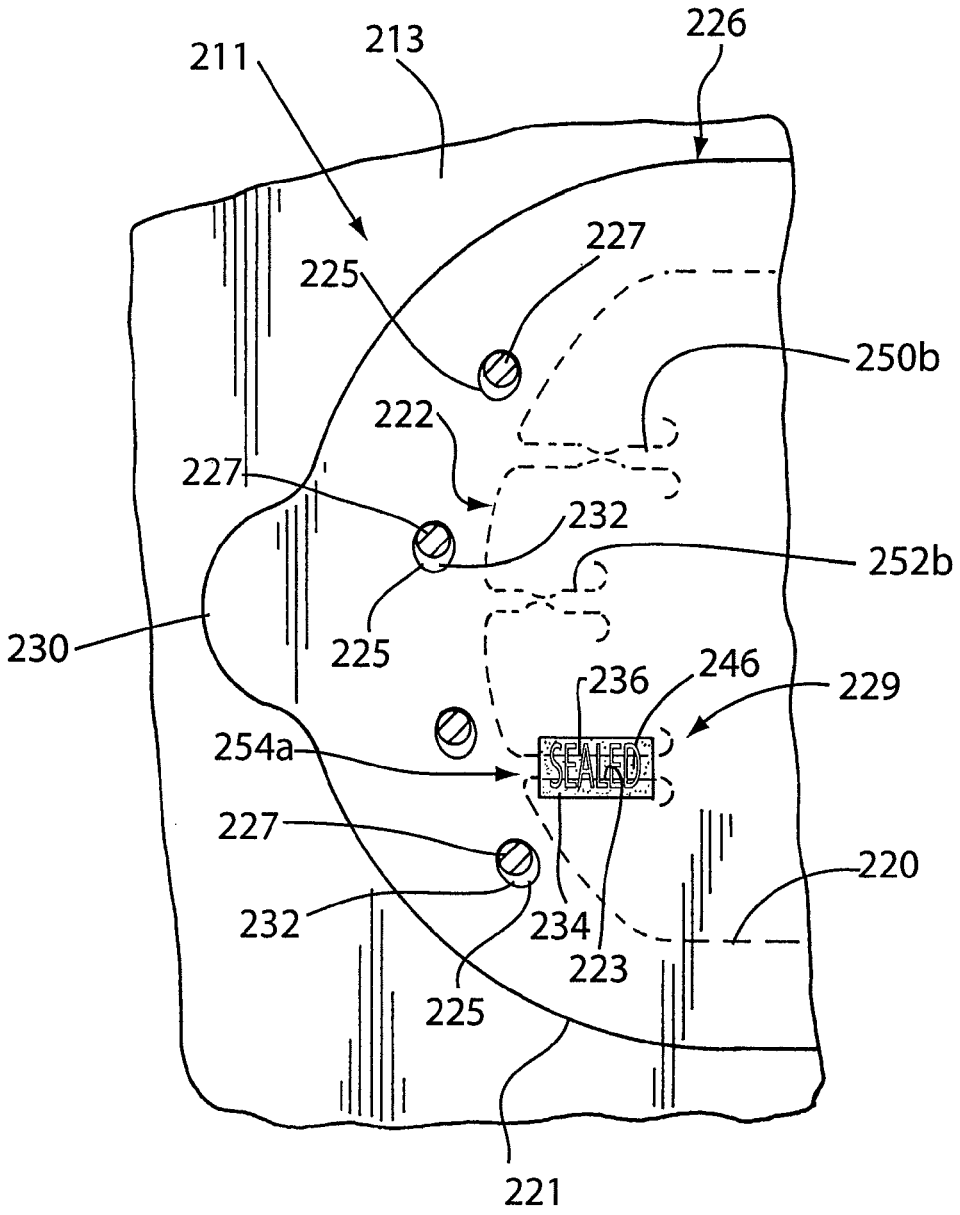
FIG. 8 is a partial plan view of the closure of FIG. 6, after an initial opening and reseal, according to the present invention.

Referring now to FIGS. 6-8, like elements of the embodiment of FIGS. 1-4 are increased by 200. The sealing panel 226 has a see-through window portion 229 which lies over strip 254 of the inner film layer 212 prior to the package 210 being opened for a first time, which permits one to visually observe the strip 254 adhered thereto prior to the package 210 being opened for a first time. Like package 10, pulling back on tab 230 separates the sealing panel 226 from the outer film layer 213 and separates the first panel 222 from the inner film layer 22 and portions of strips 250, 252 and 254. After package 210 has been opened for a first time, the strips 250, 252, 254 will break at narrowing strip portions 250*c*, 252*c*, 254*c*, producing an audible sound upon breaking, and providing a visual indication of package integrity status that the package has been previously opened, as shown in FIG. 7. In addition, package integrity status is evidenced by the absence of portions of the strip 254 being attached to the sealing panel 226 after the package 210 has been opened.

Figure 9:
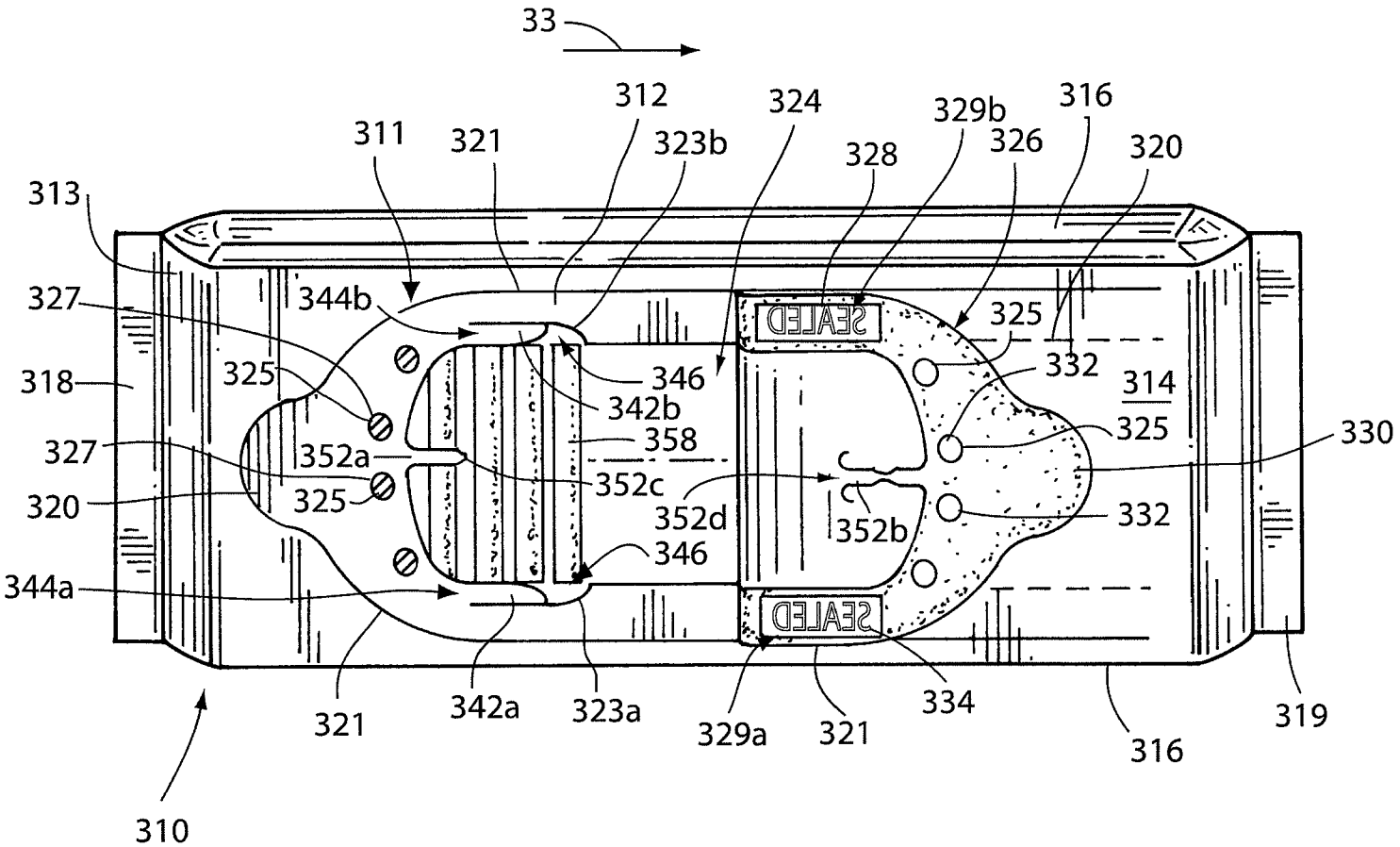
FIG. 9 is a perspective view of another package, including another closure, shown in a partially opened condition.
Figure 10:
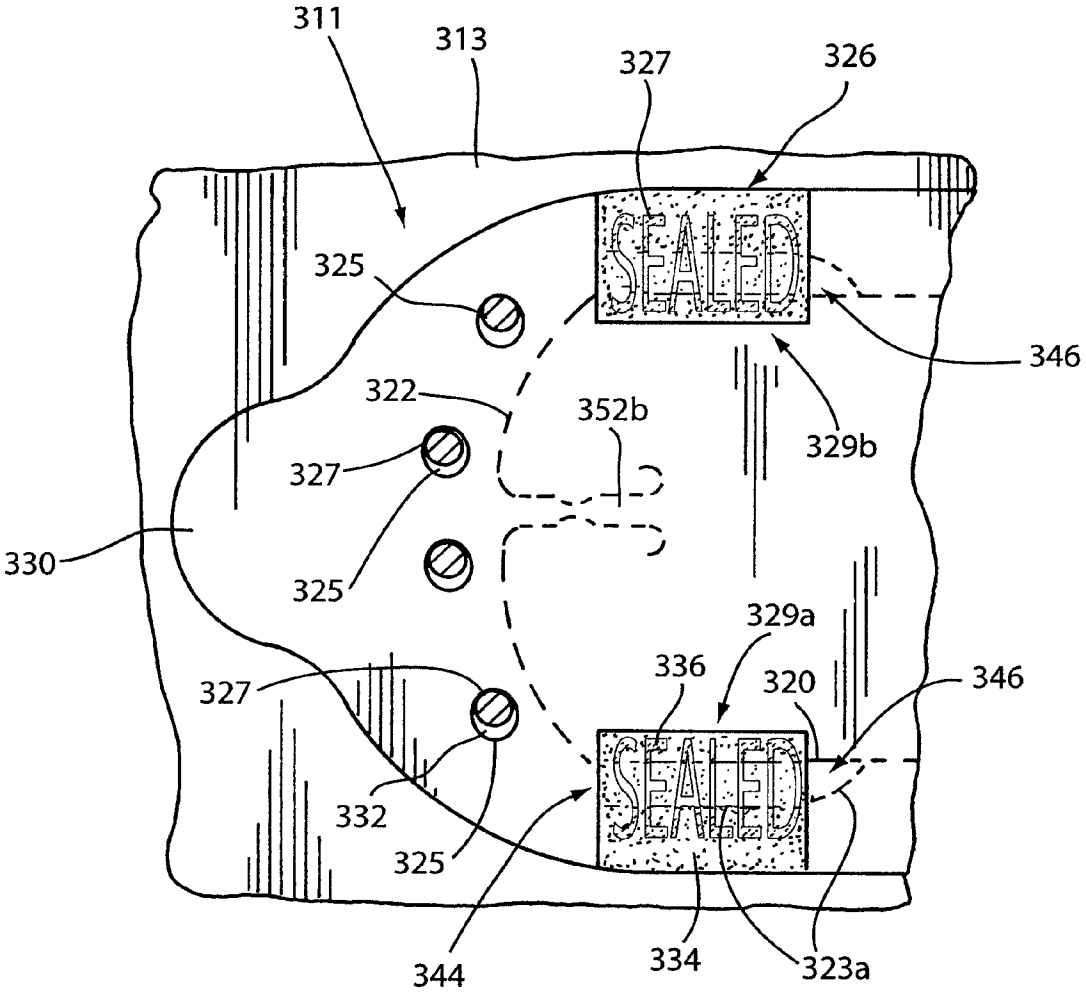
FIG. 10 is a partial plan view of the closure of FIG. 9, after an initial opening and reseal, according to the present invention.

Referring now specifically to FIG. 8, package integrity status is also indicated by the visual indication of a portion 234 of the sealing panel 226, shown as black outline letters for the word "SEALED," prior to the closure 211 being opened for a first time (FIG. 6), and a middle portion of the word "SEALED," having a void 246 which void exists because the strip 254 which was present and intact before the package was opened the first time has now fallen down into the package and is not visible at void 246. This void 246 is thus shown as not shaded after the closure has been opened and resealed (FIG. 8). In addition, like package 10, package integrity status is indicated by a slight misalignment of the sealing panel holes 232 with the tab portions 225 after the sealing panel 226 has been opened and resealed (FIG. 8) in a similar manner as package 10. Referring now to FIGS. 9 and 10, in accordance with another embodiment, package 310 has a single strip 352 located at a mid-portion of the opening 324. Package 310 is designed to accommodate a single row of food items, such as cookies 358.

Referring now to FIGS. 9 and 10, in accordance with another embodiment, package 310 has a single strip 352 located at a mid-portion of the opening 324. Package 310 is designed to accommodate a single row of food items, such as cookies 358.

Tear lines 323*a* and 323*b* form a pair of integrity indicating panels 342*a*, 342*b*, respectively. When the package 310 is opened for a first time, the panels 342*a*, 342*b* remain integrally joined to the inner film layer 312 at end 344*a*, 344*b*, even after the package 310 is opened, and the remainder of the panels 342*a*, 342*b* fall down into the opening 324, as described in more detail in the '497 application.

Package 310 includes a sealing panel 326 with a pair of see-through window portions 329*a*, 329*b* which lie over panels 342*a*, 342*b*, respectively, of the inner film layer 312 prior to the package 310 being opened for a first time. The see-through windows 329*a*, 329*b* permit one to visually observe the panels 342*a*, 342*b* adhered thereto prior to the package 310 being opened for a first time and to observe the absence of the sealing panels 342*a*, 342*b* attached to the sealing panel 326 after the package 310 has been opened to indicate package integrity status.

Once package 310 has been opened and resealed, package integrity status is evidenced by the absence of the panels 342*a*, 342*b* attached to the sealing panel 326 in a similar manner as indicated for second panel 42 in package 10. In addition, like package 10, the integrity of package 310 is observable by a misalignment of the sealing panel holes 332 with the tab portion 325 after the sealing panel 326 has been opened and resealed (FIG. 11). Further package integrity status is provided by an audible sound as strip 352 breaks when package 310 is opened for a first time.

The present invention specifically shows embodiments with three rows of food products (such as cookies) with three strips and with a single row of food products (such as cookies) and a single strip. It is to be understood that the invention is applicable to packages with any number of rows of food products, wherein the number of strips will be selected as desired, considering the number of rows of food products, the width of the package and the desired spacing of the strips. Also, different sized packages can employ any desired number of windows, whether such windows lie over second or third panels or over one or more strips. In addition, the food products can be arranged in rows across the package, or the food product may involve no rows at all, such as for peanuts. In any of these arrangements, the present invention can include any suitable number of strips and/or any suitable number of sealed windows.

As will be apparent to one of ordinary skill in the art that the present package integrity feature of the present closure offers benefits over prior tamper-evident or package integrity features.

The invention claimed is:

1. A package with an integrity feature comprising:

a two-ply film forming a package;

a resealable closure formed in the two-ply film of a top of the package, the resealable closure having a movable portion, a stationary portion, and a resealable adhesive disposed between portions of the movable and stationary portions, the movable portion being separable from the stationary portion to expose an access opening into the package; and a breakable structure affixed to both the stationary and movable portions of the resealable closure, the breakable structure defined by cuts in the two-ply film, the cuts each having a tear-limiting end that inhibits propagation of the cut, wherein the breakable structure includes a weakened portion between the cuts in the two-ply film, the weakened portion breaks upon initial opening of the package.

2. The package of claim 1 wherein the cuts comprise a plurality of discrete cuts forming a plurality of breakable structures.

3. The package of claim 1 wherein the cuts are disposed partially through the two-ply film.

4. The package of claim 1 wherein the weakened portion is in the form of a narrowing of a portion of the breakable structure.

5. The package of claim 1 wherein the breakable structure comprises an elongated strip of flexible film having opposing side edges defined by the cuts.

6. The package of claim 5 wherein the opposing side edges terminate in respective first and second tear-limiting ends.

7. The package of claim 1 wherein the tear-limiting end comprises at least one of a hook or a U-shaped configuration.

8. The package of claim 1 wherein the breakable structure breaks into two portions upon the initial opening of the package.

9. The package of claim 8 wherein a first portion of the breakable structure remains attached to the movable portion and a second portion of the breakable structure remains attached to the stationary portion after initial opening of the package.

10. The package of claim 1 wherein the breakable structure has a first end integrally connected to the movable portion and a second end integrally connected to the stationary portion.

11. A package with an integrity feature comprising:

a two-ply film forming a package;

a resealable closure formed in the two-ply film of a top of the package, the resealable closure having a movable portion, a stationary portion, and a resealable adhesive disposed between portions of the movable and stationary portions, the movable portion being separable from the stationary portion to expose an access opening into the package; and a breakable structure integral to both the stationary and movable portions of the resealable closure that breaks upon initial opening of the package, the breakable structure defined by cuts in the two-ply film, the cuts each having a tear-limiting end that inhibits propagation of the cut, wherein a first portion of the breakable structure remains attached to the movable portion after initial opening.

12. A package with an integrity feature comprising:

a two-ply film forming a package;

a resealable closure formed in the two-ply film of a top of the package, the resealable closure having a movable portion, a stationary portion, and a resealable adhesive disposed between portions of the movable and stationary portions, the movable portion being separable from the stationary portion to expose an access opening into the package; and a breakable structure permanently affixed to both the stationary and movable portions of the resealable closure that is configured to break into two portions upon initial opening of the package, the breakable structure defined by cuts in the two-ply film, the cuts each having a tear-limiting end that inhibits propagation of the cut.

13. A package with an integrity feature comprising:

a two-ply film forming a package;

a resealable closure formed in the two-ply film of a top of the package, the resealable closure having a movable portion, a stationary portion, and a resealable adhesive disposed between portions of the movable and stationary portions, the movable portion being separable from the stationary portion to expose an access opening into the package; and a breakable structure affixed to both the stationary and movable portions of the resealable closure, the breakable structure breaks upon initial opening of the package, the breakable structure defined by cuts in the two-ply film, the cuts each having a tear-limiting end that inhibits propagation of the cut, the tear-limiting ends disposed away from an edge of the access opening.

* * * * *